US005455154A

United States Patent [19]

Helling et al.

[11] Patent Number: 5,455,154

[45] Date of Patent: Oct. 3, 1995

[54] PHOTOGRAPHIC RECORDING MATERIAL

[75] Inventors: Günter Helling, Odenthal, Germany; Jean-Marie Dewanckele, Drongen, Belgium

[73] Assignee: Agfa Gevaert, AG, Leverkusen, Germany

[21] Appl. No.: 247,875

[22] Filed: May 23, 1994

[30] Foreign Application Priority Data

Jun. 3, 1993 [DE] Germany ..... 43 18 438.3

[51] Int. Cl.[6] ..... G03C 1/30

[52] U.S. Cl. ..... 430/536; 430/609; 430/621; 430/623; 430/627; 430/909

[58] Field of Search ..... 430/536, 621, 430/627, 609, 909, 623

[56] References Cited

U.S. PATENT DOCUMENTS

| | | | |
|---|---|---|---|
| 2,211,323 | 8/1940 | Fordyce | 95/7 |
| 3,415,653 | 12/1968 | Smith et al. | 96/114 |
| 4,315,071 | 2/1982 | Fitzgerald | 430/627 |
| 4,350,759 | 9/1982 | Fitzgerald et al. | 430/630 |
| 4,895,791 | 1/1990 | Mukunoki | 430/636 |
| 5,229,260 | 7/1993 | Takamuki et al. | 430/621 |

FOREIGN PATENT DOCUMENTS

| | | |
|---|---|---|
| 0339371 | 11/1989 | European Pat. Off. . |
| 0370226 | 5/1990 | European Pat. Off. . |
| 1459681 | 10/1966 | France . |

*Primary Examiner*—Thorl Chea
*Attorney, Agent, or Firm*—Connolly & Hutz

[57] ABSTRACT

A photographic silver halide material which has at least one light-sensitive layer and contains in at least one layer a compound corresponding to formula (I) in a quantity of at least 10 mg/m$^2$:

(I)

wherein k stands for 50 to 99% by weight, l stands for 0 to 49% by weight, m stands for 1 to 40% by weight, j stands for 0 to 49% by weight, M denotes a comonomer incorporated by polymerisation, $M_1$ denotes $M_2$ denotes $R_1$ and $R_2$ denote hydrogen or alkyl, $R_3$ denotes an acidic group, and B denotes a chemical bond or a bridging member and which is hardened with a rapid or an instant hardener, is distinguished by improved wet scratch resistance and stability in storage.

18 Claims, No Drawings

PHOTOGRAPHIC RECORDING MATERIAL

This invention relates to a photographic recording material with improved wet scratch resistance and stability in storage.

Photographic materials mainly contain gelatine as binder. The layers which contain binder are cross-linked with a cross-linking agent or hardener to impart sufficient stability and strength to the materials in the dry and wet state and during processing. Formaldehyde, formaldehyde hydrates and formaldehyde releasing agents were previously used as hardeners (U.S. Pat. No. 2,739,059) but when it was found that aldehydes damage the colour couplers in the colour photographic materials a search was made for new hardeners. Hardeners which do not have the above-mentioned disadvantages and could be used in modern multiple casting systems such as cascade and curtain casters were then developed. These hardeners act very rapidly and are known as rapid or instant hardeners.

The present invention relates particularly to photographic materials which are hardened with these hardeners, in particular instant hardeners.

Instant hardeners are compounds which cross-link suitable binders at such a rate that hardening has been sufficiently completed immediately after casting or at latest after 24 hours, preferably after not more than 8 hours, to ensure that no further change in the sensitometry and swelling of the combination of layers occurs as a result of the cross-linking reaction. By swelling is meant the difference between the wet layer thickness and the dry layer thickness in films which are processed under aqueous conditions (Photogr. Sci. Eng. 8 (1964), 275; Photogr. Sci. Eng. (1972), 449).

Rapid and instant hardeners have the disadvantage that the wet scratch resistance is too low and the swelling factor too high due to the brief hardening time.

Another disadvantage of using gelatine as binder is that the stability of the photographic material, in particular the stability to light, is not satisfactory.

U.S. Pat. No. 4,912,023 describes the use of water-soluble polyacrylic acid/polyvinyl alcohol block copolymers as binder additives in photographic materials. These compounds cause optical brightening agents to be more firmly fixed in the photographic materials.

One disadvantage of these compounds, however, is that they deleteriously affect the hardening of these layers with instant hardeners and the wet scratch resistance and swelling factor do not meet the requirements of a modern photographic material.

It was therefore an object of the present invention to provide a binder or binder additive for gelatine which enables the photographic layers to be hardened with instant hardeners and avoids the above-mentioned disadvantages.

It has now been found that this problem can be solved by means of certain vinyl alcohol copolymers, hereinafter referred to as CO-PVA.

The present invention therefore relates to a photographic recording material containing, in at least one layer, at least one compound corresponding to formula (I) in a quantity of at least 10 mg/m$^2$:

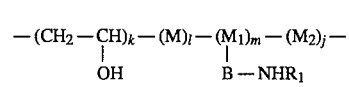

$$-(CH_2-\underset{\underset{OH}{|}}{CH})_k-(M)_l-(\underset{\underset{B-NHR_1}{|}}{M_1})_m-(M_2)_j- \quad (I)$$

wherein k denotes from 50 to 99% by weight, preferably from 70 to 97% by weight, l stands for 0 to 49% by weight, preferably from 0 to 27% by weight, m stands for 1 to 40% by weight, preferably from 3 to 15% by weight, and j stands for 0 to 49% by weight, preferably from 0 to 27% by weight, M denotes a comonomer incorporated by polymerisation, $M_1$ denotes

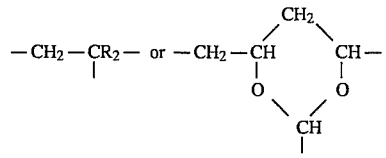

$M_2$ denotes

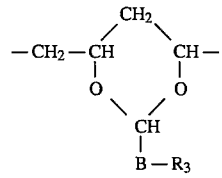

$R_1$ and $R_2$ denote hydrogen or alkyl, $R_3$ denotes an acidic group, preferably a —COOH, —$SO_3H$ or —$PO_3H$ groups and B denotes a chemical bond or a bridging member, said material being hardened with a rapid or instant hardener.

B preferably corresponds to the formula $$-L_1-(L_2)_n-(L_3)_o-,$$

wherein $L_1$ and $L_3$ stand for a conventional organic linking member, in particular an optionally substituted alkylene, arylene or aralkylene group having a maximum of 18 carbon atoms, $L_2$ stands for —COO—, —OC—O—, —CO—NH—, —NH—CO—, —$SO_2$—NH—, —NH—$SO_2$—, —NH—CO—O— or —NH—CO—NH— and n and o stand for 0 or 1.

$L_1$ is directly attached to $M_1$.

The molecular weight of the compound of formula (I) is in particular from 10,000 to 500,000, preferably from 20,000 to 200,000 (weight average).

Alkyl radicals $R_1$ and $R_2$ in particular have 1 to 4 carbon atoms.

The phenylene, arylene and aralkylene radicals $L_1$ and $L_3$ preferably carry no additional substituents.

Comonomers M preferably have an acid group, in particular a carboxyl group.

Examples of such comonomers include esters and amides of acrylic acid as their derivatives, e.g. of acrylic acid, α-chloracrylic acid, methacrylic acid, (for example, acrylamide, methyl methacrylate, ethyl acrylate, ethyl methacrylate, n-propyl acrylate n-butyl acrylate, 2-ethyl hexyl acrylate, n-hexyl acrylate, octyl methacrylate, lauryl methacrylate and methylene bis-acrylamide), vinyl esters (for example, vinyl acetate, vinyl propionate and vinyl laurate), acrylonitrile, methacrylonitrile, aromatic vinyl compounds (for example, styrene, vinyl toluene, divinylbenzene, vinyl acetophenone, styrene sulphonic acid), itaconic acid, citraconic acid, crotonic acid, vinylidene chloride, vinyl alkyl ethers (for example, vinyl ethyl ether), esters of maleic acid, N-vinyl-2-pyrrolidone, N-vinyl-, 2-vinyl- and 4-vinyl-pyridine and acrylic acid and methacrylic acid.

The following are preferred: Vinyl acetate, crotonic acid, acrylic acid, methacrylic acid, itaconic acid, maleic acid, fumaric acid, styrene sulphonic acid, acrylamido- 2-methylpropane sulphonic acid, sulphoethylmethacrylate, vinyl sulphonic acid.

Further preferred compounds of formula I contain a copolymerised comonomer M with acidic groups and/or the group $M_2$.

In this case l and j stand together from 2 to 30 mole-%.

The CO-PVA may have a random distribution of the comonomers or they may be graft or block copolymers, in particular copolymers with polyacrylic acid blocks.

From 50 mg to 5 g/m$^2$ of CO-PVA is preferably used in the at least one layer.

The following are examples of polymers according to the invention:

P-1

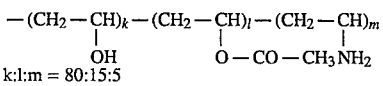

k:l:m = 80:15:5
$M_w$ = 130 000

P-2

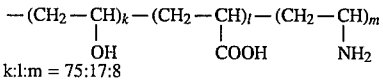

k:l:m = 75:17:8
$M_w$ = 84 000

P-3

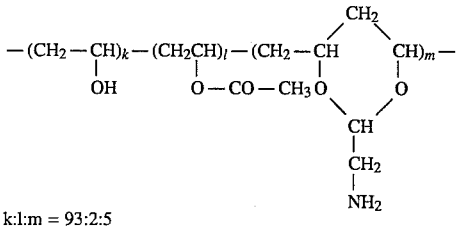

k:l:m = 93:2:5
$M_w$ = 48 000

P-4

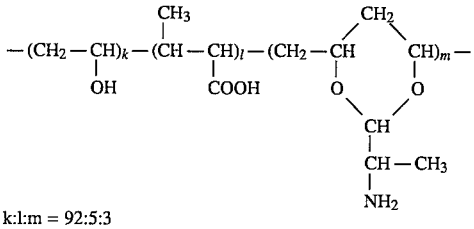

k:l:m = 92:5:3
$M_w$ = 200 000

P-5

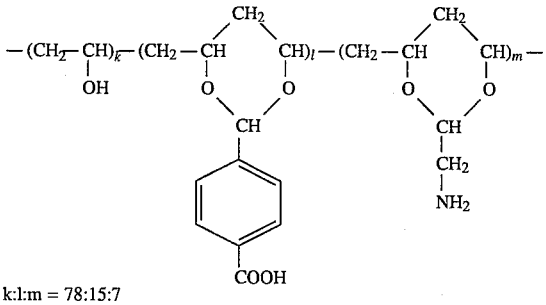

k:l:m = 78:15:7

-continued $M_w$ = 23 000

P-6

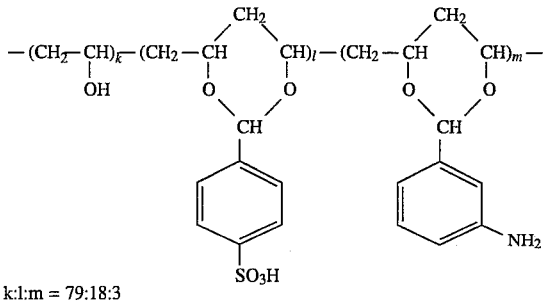

k:l:m = 79:18:3
$M_w$ = 95 000

P-7

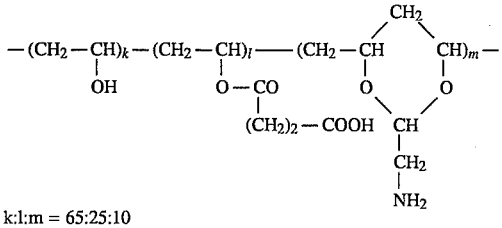

k:l:m = 65:25:10
$M_w$ = 70 000

P-8

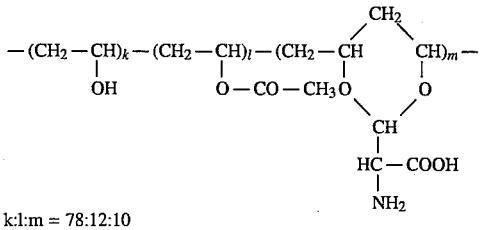

k:l:m = 78:12:10
$M_w$ = 63 000

P-9

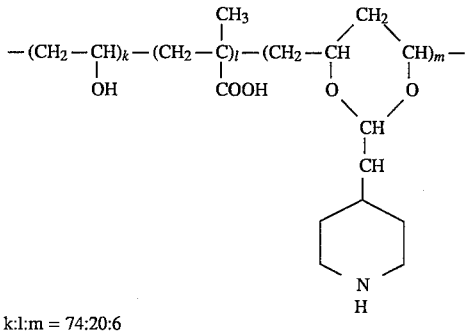

k:l:m = 74:20:6
$M_w$ = 105 000.

The CO-PVA according to the invention may be used as binders in photographic materials without any additional binders although mixtures with known binders such as gelatine, polyvinyl pyrrolidone or polyvinyl alcohol are preferably used. Mixtures with gelatine are particularly preferred. When CO-PVA-gelatine mixtures are used, the ratio by weight of CO-PVA: gelatine is generally adjusted to a value from 90:10 to 5:95, preferably from 60:40 to 10:90.

The PVA copolymers according to the invention may be used in all layers of photographic materials which contain binder but they may equally be used in only one or some of the layers. For example, by adding CO-PVA to only one layer of the combination of layers, this layer may be more strongly cross-linked than the others.

The layer may be hardened to differing degrees by the addition of differing quantifies of CO-PVA to different gelatine-containing layers so that a hardening profile can be established.

The CO-PVA are preferably used in at least two layers of the photographic material. To improve the stability of dyes to light, one CO-PVA layer should be arranged above and another CO-PVA layer below the layer containing the dye which is to be protected. It is immaterial whether the layers containing the CO-PVA are emulsion layers, subbing layers, interlayers or protective layers.

The use of CO-PVA in two layers above and below a coupler containing layer is particularly useful if the coupler is a pyrazolotriazole coupler. The stabilization of the magenta dye obtained from the pyrazolotriazole coupler by processing is further improved by the addition of specific dye stabilisers.

The following dye stabilisers are particularly useful not only for magenta dyes but also for other dyes particularly yellow dyes.

Suitable dye stabilisers belong to the following groups St-I to St-IV:

St-I

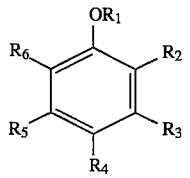

St-II

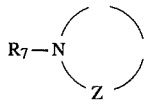

St-III

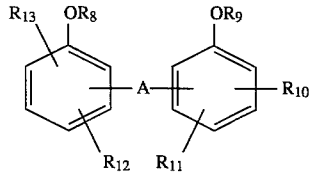

ST-IV

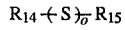

Preferably in addition thereto a compound of the formulae St-V to St-VIII is added to photographic material in order to reduce the fog.

St-V

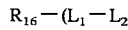

St-VI

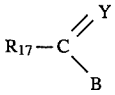

St-VII

St-VIII

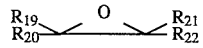

In formulae St-I to St-VIII $R_1$, $R_8$ and $R_9$ denote H, alkyl, aryl or a group being split off under alkalinic conditions, $R_2$, $R_3$, $R_4$ denote —COOH, —$SO_3H$, —$SO_2H$, alkyl, aryl, acyl, alkylsulfonyl, arylsulfonyl, alkenyl, sulfamoyl, acylamino, alkylthio, arylthio, ureido, cycloalkyl, carbamoyl, carbamoyloxy or a alkoxycarbonylamino, $R_5$ and $R_6$ denote OH, $OR_1$ or $R_2$, $R_3$ and $R_4$ can stand together with the atoms of the phenyl ring to which they are linked an annellated 5 to 6-membered carbocyclic ring, $R_7$ denotes aryl, optionally substituted by OH, $OR_1$, $R_2$, alkoxy carbonyl or dialkyl amino, $R_{10}$, $R_{11}$, $R_{12}$, $R_{13}$ denote OH, $OR_1$, $R_2$, alkoxycarbonyl, dialkylamino, alkoxycarbonyloxy or halogen, $R_{14}$ denotes alkyl, cycloalkyl, aryl or alkenyl, $R_{15}$ denotes H, acyl, carbamoyl, alkoxycarbonyl or $R_{14}$, $R_{16}$, $R_{17}$, $R_{18}$ denotes alkyl, cycloalkyl, alkenyl, alkinyl, aryl, heterocyclyl, wherein aryl and heterocyclyl may be benzo-annellated, $R_{19}$, $R_{20}$, $R_{21}$ and $R_{22}$ denote H, alkyl, aryl, alkoxycarbonyl, aryloxycarbonyl or a carbamoyl, wherein the sum of the carbon atoms of $R_{19}$, $R_{20}$, $R_{21}$ and $R_{22}$ is at least 8 and two of $R_{19}$, $R_{20}$, $R_{21}$ and $R_{22}$ may stand together for a 5- to 7-membered ring, $Z_1$, $Z_2$ denote $C_1$-$C_3$-alkylene, optionally substituted by OH, $OR_1$, $R_2$, alkoxycarbonyl, dialkylamino or a alkoxycarbonyloxy, wherein the sum of the carbon atoms in the alkylene chains of $Z_1$ and $Z_2$ is 3 to 6, A denotes $C_1$-$C_6$-alkylene, optionally substituted —O—, —$S(O)_p$— or

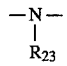

B denotes H, alkyl, aryl, heterocyclyl, acyl, alkylsulfonyl or arylsulfonyl, $L_1$ denotes a single linkage, alkylene,—O—, —S—, —NH— or alkylimino, $L_2$ denotes carbonyl, sulfinyl, sulfonyl, thiocarbonyl, hydroxyphosphoryl, iminomethandiyl, dialkylsilandiyl, $X_1$ denotes aryloxy, alkyloxy, heterocyclyloxy, alkylthio, arylthio, heterocyclylthio, halogen, $X_2$ denotes —$SO_2M$, —SH, alkylamino, azacylcoalkyl, M denotes H, alkali metal, optionally substituted ammonium, methylenhydrazino, carbonylhydrazo, sulfonylhydrazo, carbonylacetylmethyl, carbonylcarbonyldioxymethyl, Y denotes oxo, thioxo, =N—$R_{24}$,

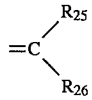

$R_{24}$, $R_{25}$, $R_{26}$ denote H, alkyl, aryl, heterocyclyl, acyl, alkylsulfonyl, arylsulfonyl, cyano or $R_{25}$ and R26 together denote the remaining members of a ring, n denotes 0, 1 or 2, m denotes O, if $X_1$ is halogen, and 1, if $X_1$ is not halogen, p denotes 0, 1 or 2, R23 denotes H, alkyl, aryl, acyl, alkylsulfonyl, alkoxycarbonyl, aryloxycarbonyl, arylsulfonyl, carbamoyl or alkoxycarbonyl.

Alkyl-, aryl-, cycloalkyl- and heterocyclyl residues may be substituted.

The following compounds are examples of groups St-I to St-VIII:

St-I-1
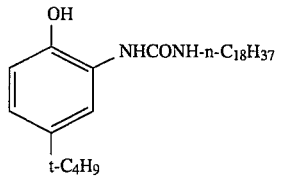
St-I-2
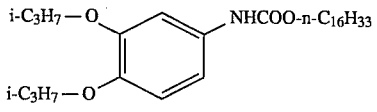
St-I-3
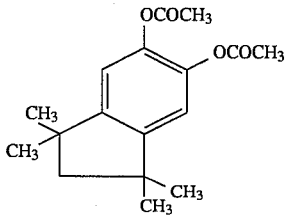
St-I-4
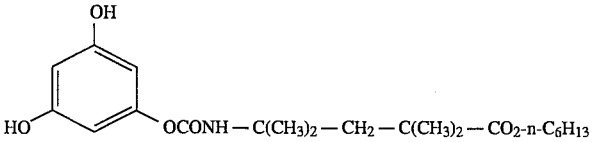
St-I-5
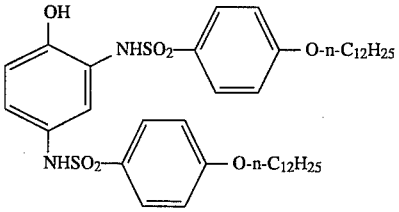
St-I-6
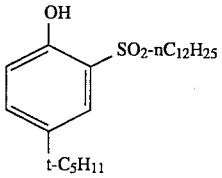
St-I-7
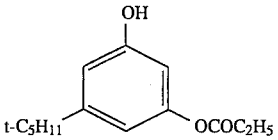
St-I-8
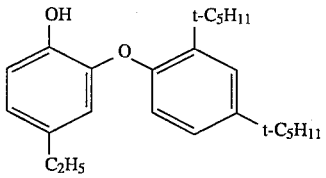
St-I-9
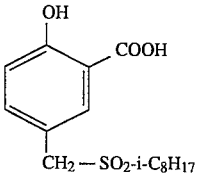
St-I-10
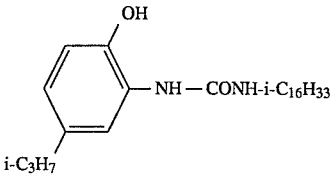
St-I-11
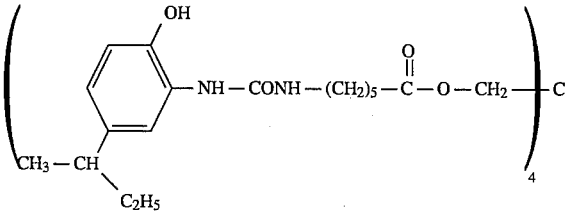
St-I-12
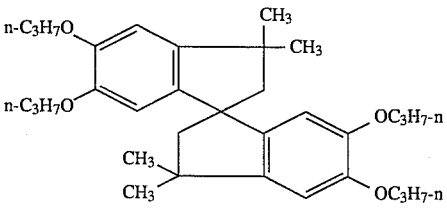
St-I-13
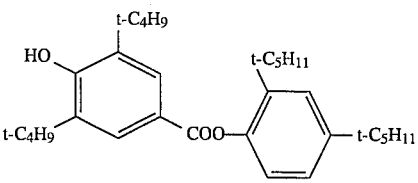

-continued
St-I-14
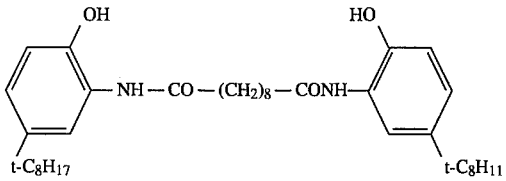
St-II-1
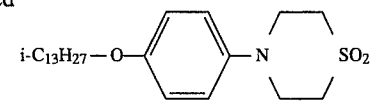
St-II-2
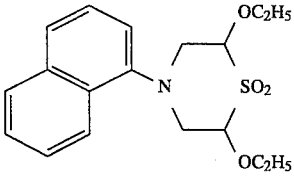
St-II-3
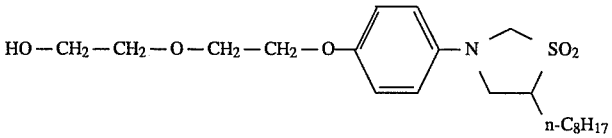
St-II-4
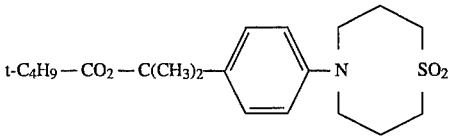
St-II-5
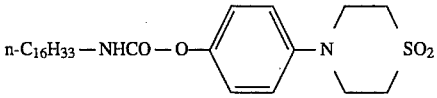
St-II-6
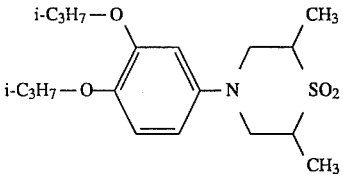
St-II-7
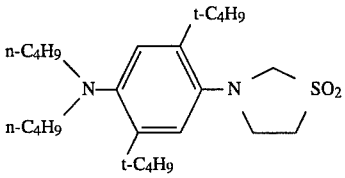
St-II-8
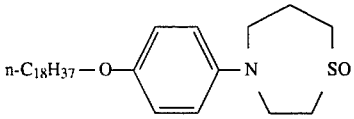
St-III-1
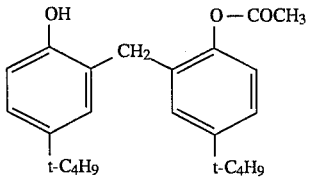
St-III-2
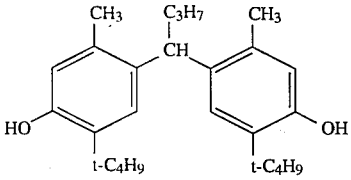
St-III-3
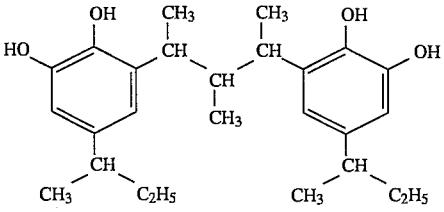
St-III-4
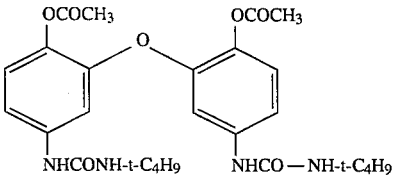
St-III-5
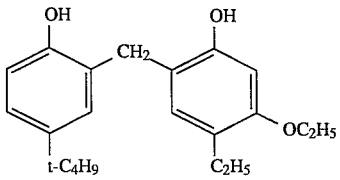

-continued
St-III-6
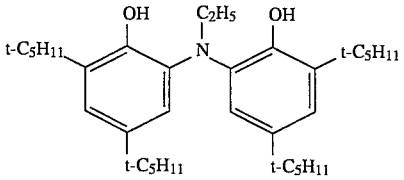
St-III-7
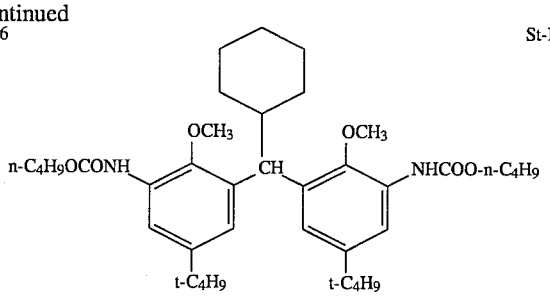
St-III-8
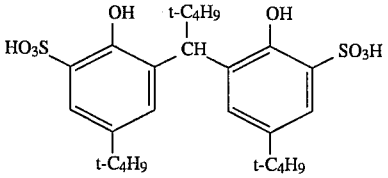
St-III-9
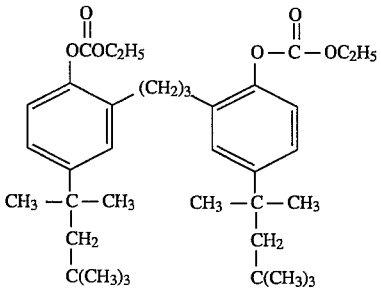
St-IV-1
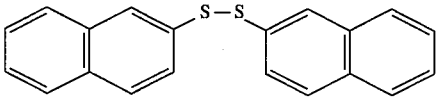
St-IV-2
$S(CH_2-CH_2-COO\text{-}n\text{-}C_{14}H_{29})_2$
St-IV-3
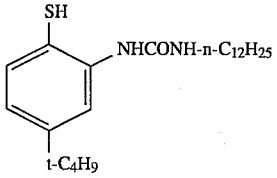
St-IV-4
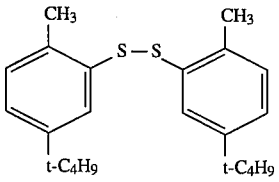
St-IV-5
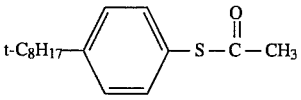
St-IV-6
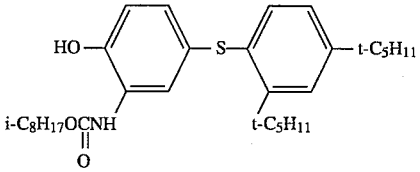
St-IV-7
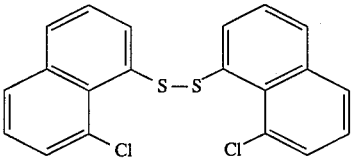
St-IV-8
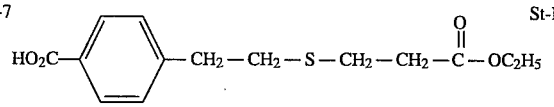
St-V-1
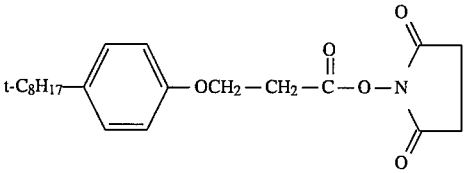
St-V-2
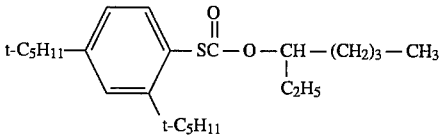
St-V-3
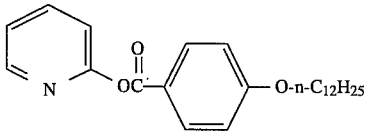

-continued
St-V-4
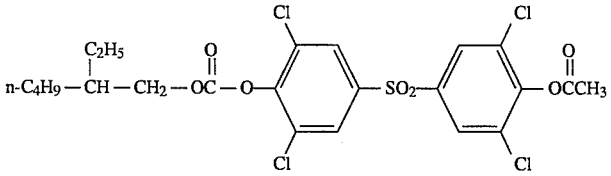
St-V-5
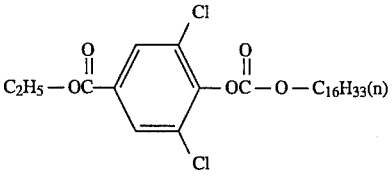
St-V-6
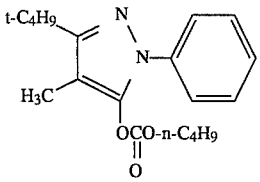
St-V-7
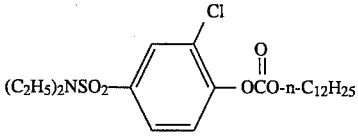
St-V-8
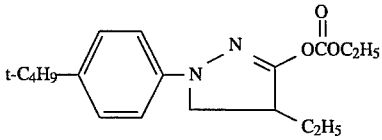
St-V-9
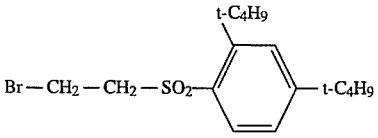
St-V-10
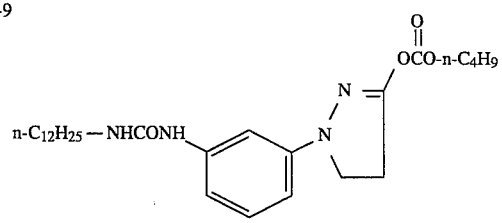
St-VI-1
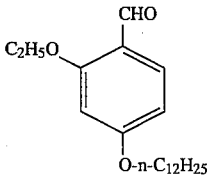
St-VI-2
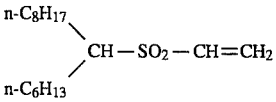
St-VI-3
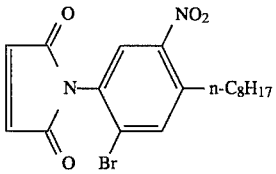
St-VII-1
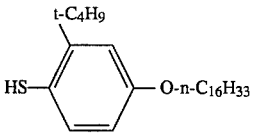
St-VII-2
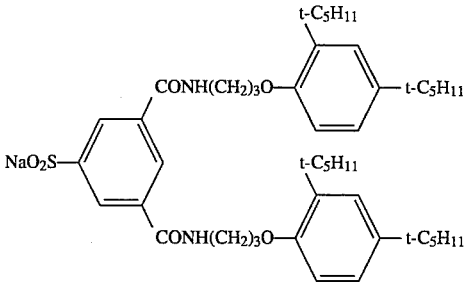
St-VII-3
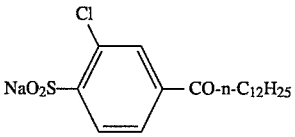
St-VII-4
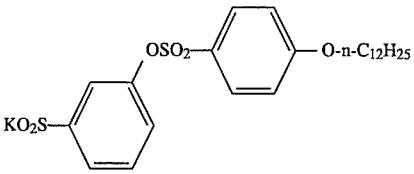
St-VII-5
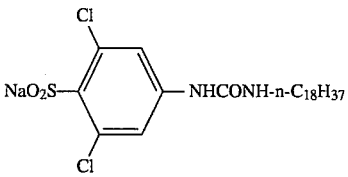

-continued

St-VII-6

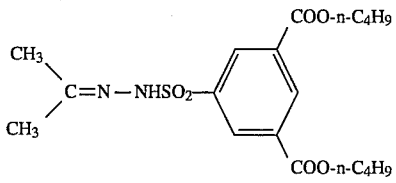

St-VII-7

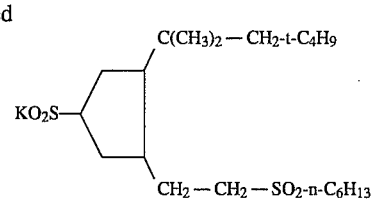

St-VIII-1

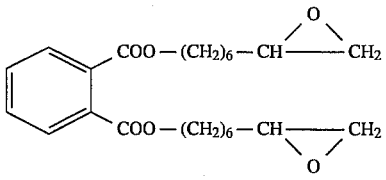

St-VIII-2

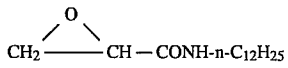

St-VIII-3

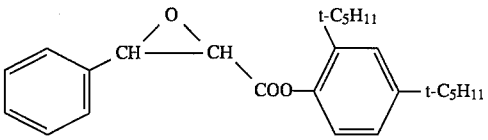

St-VIII-4

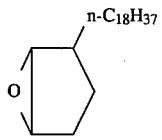

St-VIII-5

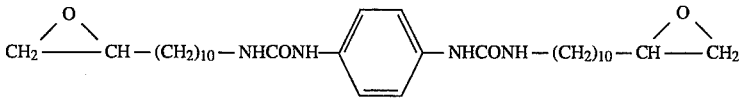

St-VIII-6

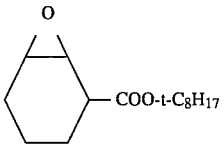

St-VIII-7

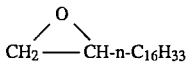

The dye stabilisers are preferably used in an amount of from 0.05 to 1 g/m$^2$. This amount can be in one layer or distributed in several layers.

The CO-PVA may be synthesised by methods known from the literature, e.g. U.S. Pat. No. 2,739,059. For example, the amino group may be introduced by reacting a polymer which has vinyl alcohol structural elements with aminoalkyl aldehyde acetal. The vinyl alcohol/vinylamine copolymers may be prepared by the method described in DE-33 26 187.

The synthesis of a CO-PVA copolymer containing amino and carboxyl groups is described below by way of example:

12 g of a polyvinyl alcohol having a molecular weight of 70,000 were dissolved in 230 g of water and 15 g of concentrated hydrochloric acid were added. 3.5 g of 4-carboxybenzaldehyde in 75 ml of isopropanol and 35 g of concentrated hydrochloric acid were then added simultaneously in 20 minutes and the reaction mixture was stirred at 30° C. 3.3 g of aminoacetaidehyde dimethylacetal in 25 ml of isopropanol were then added dropwise and the reaction mixture was heated to 70° C. for 3 hours. The pH was then adjusted to 6 with soda solution and the solution was dialysed.

The CO-PVA and CO-PVA-gelatine mixtures were hardened with rapid or instant hardeners according to the invention.

Rapid and instant hardeners are compounds which in the following test show a layer melting point of at least 95° C. Instant hardeners fulfill in addition the previously mentioned definition.

Hardening test:

A support, e.g. paper coated on both sides with polyethylene or film of cellulose triacetate, is coated with a coating liquid, which contains gelatine and, based on the amount of gelatine, 1% by weight of the hardening agent. The coating is dried at pH 6.2 and 35° C. and then immersed into an aqueous bath which is heated continuously within at least 5 minutes from 20° C. to 100° C. The temperature at which the layer runs off the support, detected by the formation of flaws, is denoted as the melting point.

Using the hardeners of the invention no melting can be detected up to 100° C. whereas with the same amount of formaldehyde as the hardening agent a melting point of 75° C. is obtained.

The hardeners may be of the type which are incorporated in the binder, for example hydroxydichlorotriazine and divinylsulfone hardeners, or of the type which bring about cross-linking of the binder without being incorporated therein, e.g. hardeners which activate carboxyl groups. So-called instant hardeners are preferably used.

Compounds corresponding to the following general formulae are suitable examples:

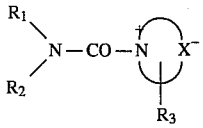

(a)

wherein $R_1$ denotes alkyl, aryl or aralkyl, $R_2$ has the same meaning as $R_1$ or stands for alkylene, arylene, aralkylene or alkaralkylene and the second bond is linked to a group of the following formula

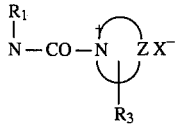

or $R_1$ and $R_2$ together denote the atoms required for completing an optionally substituted heterocyclic ring, for example a piperidine, piperazine or morpholine ring, which ring may be sustituted, e.g. by $C_1$-$C_3$-alkyl or halogen, $R_3$ stands for hydrogen, alkyl, aryl, alkoxy, $NR_4$—$COR_5$, —$(CH_2)_m$—$NR_8R_9$, —$(CH_2)_n$—$CONCR_{13}R_{14}$ or

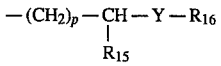

or a bridging member or a direct link to a polymer chain, $R_4$, $R_6$, $R_7$, $R_9$, $R_{14}$, $R_{15}$, $R_{17}$, $R_{18}$ and $R_{19}$ denote hydrogen or $C_1$-$C_4$-alkyl, $R_5$ denotes hydrogen, $C_1$-$C_4$-alkyl or $NR_6R_7$, $R_8$ denotes $COR_{10}$, $R_{10}$ denotes $NR_{11}R_{12}$, $R_{11}$ denotes $C_1$-$C_4$-alkyl or aryl, in particular phenyl, $R_{12}$ denotes hydrogen, $C_1$-$C_4$-alkyl or aryl, in particular phenyl, $R_{13}$ denotes hydrogen, $C_1$-$C_4$-alkyl or aryl, in particular phenyl, $R_{16}$ denotes hydrogen, $C_1$-$C_4$-alkyl, $COR_{18}$ or $CONHR_{19}$, while m stands for a number from 1 to 3, n stands for a number from 0 to 3, p stands for a number from 2 to 3 and Y stands for O or $NR_{17}$ or $R_{13}$ and $R_{14}$ together denote the atoms required for completing an optionally substituted heterocyclic ring, for example a piperidine, piperazine or morpholine ring, which ring may be substituted, e.g. by $C_1$-$C_3$-alkyl or by halogen, Z denotes the carbon atoms required for completing a 5-membered or 6-membered aromatic heterocyclic ring optionally with condensed benzene ring attached and $X^{\ominus}$ denotes an anion, which is absent if an anionic group is already linked to the remainder of the molecule;

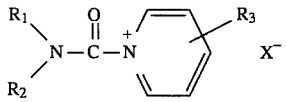

(b)

wherein $R_1$, $R_2$, $R_3$ and $X^{\ominus}$ have the meanings indicated for formula (a);

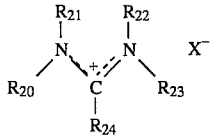

(c)

wherein $R_{20}$, $R_{21}$ and $R_{22}$ denote $C_1$-$C_{20}$-alkyl, $C_6$-$C_{20}$-aralkyl or $C_5$-$C_{20}$-aryl, in each case unsubstituted or substituted by halogen, sulpho, $C_1$-$C_{20}$-alkoxy or an N,N-di-$C_1$-$C_4$-alkyl-substituted carbamoyl, and aralkyl and aryl may be substituted by $C_1$-$C_{20}$-alkyl, R24 denotes a group which can be split off by a nucleophilic agent and $X^{\ominus}$ has the meaning indicated for formula (a) and 2 or 4 of the substituted $R_{20}$, $R_{21}$, $R_{22}$ and $R_{23}$ together with a nitrogen atom or with the group

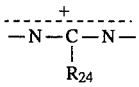

may be combined to form one or two saturated 5- to 7-membered rings, optionally with the inclusions of further hetero atoms such as O or N;

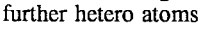

(d)

wherein $R_{25}$ denotes $C_1$-$C_{10}$-alkyl, $C_5$-$C_8$-cycloalkyl, $C_3$-$C_{10}$-alkoxyalkyl or $C_7$-$C_{15}$-aralkyl, $R_{26}$ has the meaning of $R_{25}$ or stands for a group of the formula

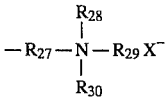

wherein $R_{27}$ denotes $C_2$-$C_4$-alkylene and $R_{28}$, $R_{29}$ and $R_{30}$ denote $C_1$-$C_6$-alkyl and one of the groups $R_{28}$, $R_{29}$ and $R_{30}$ may be substituted by a carbamoyl group or a sulpho group and two of the groups $R_{28}$, $R_{29}$ and $R_{30}$ together with the nitrogen atom may be joined together to form an optionally substituted heterocyclic ring, for example a pyrrolidine, piperazine or morpholine ring, which ring, may be substituted, e.g. by $C_1$-$C_3$-alkyl or by halogen, and $X^{\ominus}$ has the meaning indicated for formula (a);

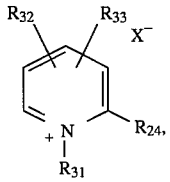

(e)

wherein $X^{\ominus}$ has the meaning indicated for formula (a), $R_{24}$ has the meaning indicated for formula (c), $R_{31}$ denotes $C_1$-$C_{10}$-alkyl, $C_6$-$C_{15}$-aryl or $C_7$-$C_{15}$-aralkyl, in each case unsubstituted or substituted by carbamoyl, sulphamoyl or sulpho, $R_{32}$ and $R_{33}$ denote hydrogen, halogen, acylamino, nitro, carbamoyl, alkoxy, alkyl, alkenyl, aryl or aralkyl or together they stand for the remaining members of a ring which is condensed with the pyridinium ring, in particular a benzene ring, and $R_{24}$ and $R_{31}$ may be linked together when $R_{24}$ is a sulphonyloxy group;

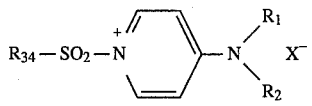

(f)

wherein $R_1$, $R_2$ and $X^{\ominus}$ have the meanings indicated for formula (a) and $R_{34}$ denote $C_1$-$C_{10}$-alkyl, $C_6$-$C_{14}$-aryl or $C_7$-$C_{15}$-aralkyl;

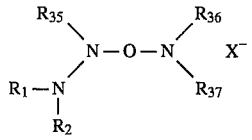

(g)

wherein $R_1$, $R_2$ and $X^{\ominus}$ have the meanings indicated for formula (a), $R_{35}$ denotes hydrogen, alkyl, aralkyl, aryl, alkenyl, $R_{38}O$—, $R_{39}R_{40}N$—, $R_{41}R_{42}C{=}N$— or $R_{38}S$—, $R_{36}$ and $R_{37}$ denote alkyl, aralkyl, aryl, alkenyl, $R_{43}$—CO—, $R_{44}$—$SO_2$— or $R_{45}$—N= N— or together with the nitrogen atom they denote the remaining members of a heterocyclic ring or the group

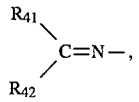

$R_{38}$, $R_{39}$, $R_{40}$, $R_{41}$, $R_{42}$, $R_{43}$, $R_{44}$ and $R_{45}$ denote alkyl, aralkyl or alkenyl and $R_{41}$ and $R_{42}$ may also denote hydrogen, and $R_{39}$ and $R_{40}$ together and $R_{41}$ and $R_{42}$ together may also denote the remaining members of a 5- or 6-membered saturated carbocyclic or heterocyclic ring;

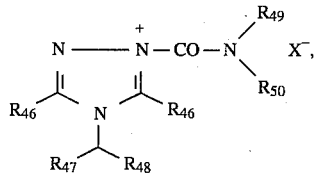

(h)

wherein $R_{46}$ denotes hydrogen, alkyl or aryl, $R_{47}$ denotes acyl, carbalkoxy, carbamoyl or aryloxy carbonyl;

$R_{48}$ denotes hydrogen or $R_{47}$, $R_{49}$ and $R_{50}$ denote alkyl, aryl or aralkyl or together with the nitrogen atom they denote the remaining members of an optionally substituted heterocyclic ring, for example a piperidine, piperazine or morpholine ring, which ring may be substituted, e.g. by $C_1$-$C_3$-alkyl or by halogen, and $X^{\ominus}$ has the meaning indicated for formula (a);

$$R_{51}—(SO_2—CH{=}CH_2)_q \qquad (i)$$

wherein $R_{51}$ denotes alkylene with 1 to 6 carbon atoms optionally once or several times interrupted by —O—, —$NR_{52}$—, —CONH—, —NHCO—, —NHCONH—, —$SO_2$—, —$SO_2$NH— or phenylene or an optionally substituted heteroaromatic ring containing at least q ring carbon atoms and at least one ring oxygen, ring sulphur or ring nitrogen atom, $R_{52}$ stands for hydrogen or $C_1$-$C_4$-alkyl and q stands for an integer ≧2.

The heteroaromatic ring denoted by $R_{51}$ may be, for example, a triazole, thiadiazole, oxadiazole, pyridine, pyrrole, quinoxaline, thiophene, furan, pyrimidine or triazine ring. In addition to the at least two vinyl sulphonyl groups it may contain further substituents and optionally condensed benzene rings which may in turn be substituted. Examples of heteroatomic rings ($R_{51}$) are shown below:

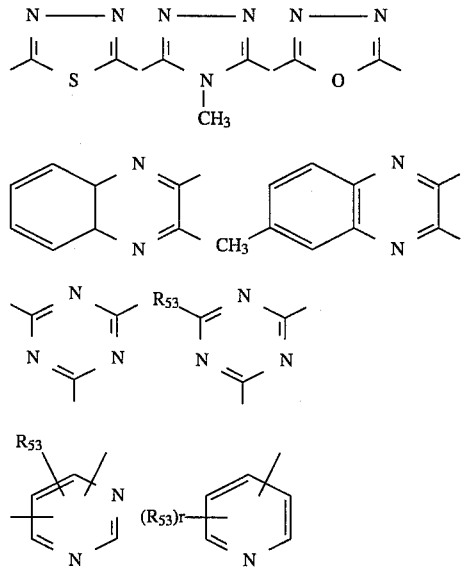

wherein r denotes a number from 0 to 3 and $R_{53}$ denotes $C_1$-$C_4$-alkyl, $C_1$-$C_4$-alkoxy or phenyl.

Further examples for $R_{51}$ are —$CH_2$—, —$CH_2$—O—$CH_2$—, —$CH_2$—CONH—$CH_2$—, —$CH_2$—NHCONH—$CH_2$—.

The compounds described in Japanese Specifications 38 580/75, 93 470/77, 43 353/81 and 113 929/83 and in U.S. Pat. No. 3,321,313 are also suitable as instant hardeners. The alkyl group is in particular $C_1$-$C_{20}$-alkyl optionally substituted by halogen, hydroxy, sulpho or $C_1$-$C_{20}$-alkoxy, unless otherwise defined.

Aryl, unless otherwise defined, is in particular $C_6$-$C_{14}$-aryl optionally substituted by halogen, sulpho, $C_1$-$C_{20}$-alkoxy or $C_1$-$C_{20}$-alkyl; aralkyl is in particular $C_7$-$C_{20}$-aralkyl optionally substituted by halogen, $C_1$-$C_{20}$-alkoxy, sulpho or $C_1$-$C_{20}$-alkyl unless otherwise defined; alkoxy is in particular $C_1$-$C_{20}$-alkoxy unless otherwise defined.

$X^{\ominus}$ is preferably a halide ion such as $Cl^{\ominus}$, $Br^{\ominus}$ or $BF_4^{\ominus}$, $NO_3^{\ominus}$, $(SO_4^{2\ominus})_{1/2}$, $ClO_4^{\ominus}$, $CH_3OSO_3$, $PF_6^{\ominus}$ or $CF_3SO_3^{\ominus}$.

Alkenyl is in particular $C_2$-$C_{20}$-alkenyl; alkylene is in particular $C_2$-$C_{20}$-alkylene; arylene is in particular phenylene; aralkylene is in particular benzylene and alkaralkylene is in particular xylylene.

Suitable ring systems containing nitrogen, which may stand for Z, are illustrated on pages 8 and 9. The pyridine ring is preferred.

$R_{36}$ and $R_{37}$ together with the nitrogen atom to which they are attached form in particular a pyrrolidine or piperidine which is substituted by two oxo groups attached in the o- and o'-position and which may be benzo-, cyclohexeno- or [2.2.1]-bicyclohexeno-condensed.

Acyl is in particular $C_1$-$C_{10}$-alkylcarbonyl or benzoyl; carbalkoxy is in particular $C_1$-$C_{10}$-alkoxycarbonyl; carbamoyl is in particular mono- or di-$C_1$-$C_4$-alkylaminocarbonyl; carbaroxy is in particular phenoxycarbonyl.

Halogen atoms, $C_1$-$C_{15}$-alkylsulphonyloxy groups, $C_7$-$C_{15}$-aralkylsulphonyloxy groups, $C_6$-$C_{15}$-arylsulphonyloxy groups and 1-pyridinyl groups are examples of groups $R_{24}$ which can be split off by nucleophilic agents.

Suitable examples are disclosed in DE 38 36 945.

The hardeners are used in particular in quantities of from 50 to 500 g/m$^2$, preferably from 200 to 400 mg/m$^2$. Carbamoyl pyridinium salts (1st Formula of the Summary) and the compounds $CH_2{=}CH{-}SO_2{-}CH_2{-}SO_2{-}CH{=}CH_2$ and $CH_2{=}CH{-}SO_2{-}CH_2{-}O{-}CH_2{-}SO_2{-}CH{=}CH_2$ are preferred hardeners.

The casting solution for the hardening layer has a viscosity in particular of from 1 to 30 mPa.s and the hardening layer in particular has a wet layer thickness of from 3 to 30 μm.

In addition to the polymers used according to the invention, other polymers may be added to the layers containing binder. Examples of such polymers are: polyacrylamides, geltaine derivatives, polyacrylic acid and polymethacrylic acid and salts thereof, polyvinyl pyrrolidone, polyvinyl alcohol and polyvinyl alcohol derivatives containing carboxyl groups, polyvinyl imidazole, polyethyl acrylate, polybutyl acrylate, polyurethane latices and polyesters dispersions.

The photographic silver halide material may be a black-and-white e.g. a radiographic material or a graphic arts material including a diffusion reversal (DTR) material. The invention is particularly concerned with photographic colour material.

In black-and-white material, the acceleration of the hardening with divinylsulphon hardeners of layers containing gelatin and CO-PVA is of particular importance when the layers are coated at low pH-values which is commonly done when they contain developing agents as is the case, e.g. in DTR materials and materials which are processed by means of alkaline development activating solutions. In this way these layers are completely hardened in a relatively short time where otherwise several weeks are required. By a slow and incomplete hardening in the case of DTR-material containing a layer of developer nuclei, the nuclei would sink in the underlying insufficient hardened layer.

Examples of colour photographic materials include colour negative films, colour reversal films, colour positive films, colour photographic paper, colour reversal photographic paper and colour sensitive materials for the dye diffusion transfer process or the silver dye bleaching process.

Suitable supports for producing the colour photographic materials are, for example, films and sheets of semi-synthetic or synthetic polymers such as cellulose nitrate, cellulose acetate, cellulose butyrate, polystyrene, polyvinyl chloride, polyethylene terephthalate and polycarbonate and paper laminated with a baryta layer or with an α-olefin polymer layer (e.g. polyethylene). These supports may be coloured with dyes and pigments, for example titanium dioxide. They may also be coloured black to shield against light. The surface of the support is generally subjected to a treatment to improve the adhesiveness of the photographic emulsion layer, for example a corona discharge followed by application of a subbing layer.

The colour photographic materials normally contain at least one red-sensitive, one green-sensitive and one blue-sensitive silver halid emulsion layer and optionally interlayers and protective layer.

Binders, silver halide grains and colour couplers are essential components of the photographic emulsion layers.

The binder used in addition to the compounds of formula I is preferably gelatine although this may be partly or completely replaced by other synthetic, semi-synthetic or naturally occurring polymers. Examples of synthetic gelatine substitutes include polyvinyl alcohol, poly-N-vinyl pyrrolidone, polyacrylamides, polyacrylic acid and derivatives thereof, in particular their mixed polymers. Examples of naturally occurring gelatine substitutes include other proteins such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose and gelatine derivatives obtained by a reaction with alkylating or acylating agents or by the grafting of polymerisable monomers are examples of these.

The binders should have a sufficient quantity of functional groups available so that sufficiently resistant layers can be produced by the reaction with suitable hardeners. Such functional groups are in particular amino groups but also carboxyl groups, hydroxyl groups and active methylene groups.

Gelatine, which is the binder preferably used, may be obtained by acid or alkaline decomposition. Oxidized gelatine may also be used. The preparation of such gelatines is described, for example, in The Science and Technology of Gelatine, published by A. G. Ward and A. Courts, Academic Press 1977, page 295 et seq. The gelatine used should contain the least possible photographically active impurities (inert gelatine). Gelatines with high viscosity and low swelling are particularly advantageous.

The halid in the silver halide present as light-sensitive component of the photographic material may be chloride, bromide or iodide or mixtures of these. For example, the halide content of at least one layer may consist of 0 to 15 mol-% of iodide, 0 to 100 mol-% of chloride and 0 to 100 mol-% of bromide. Silver iodobromide emulsions are generally used for colour negative and colour reversal films while silver chlorobromide emulsions having a high chloride content up to pure silver chloride emulsions are normally used for colour negative and colour reversal paper. The silver halides may be predominantly compact crystals which may e.g. have a regular cubic or octahedral form or transitional forms by platelet shaped crystals having an average ratio of diameter to thickness of preferably at least 51 may advantageously also be present. The diameter of a grain is defined as the diameter of a circle having a surface area equal to the projected surface area of the grain. The layers may also contain tabular silver halide crystals in which the ratio of diameter to thicknesses is substantially greater than 51, e.g. from 121 to 30:1.

The silver halide grains may also have a multilayered grain structure, in the simplest case with an inner and an outer grain region (core/shell) which differ from one another in their halide composition and/or by other modifications, e.g. doping. The average grain size of the emulsions is preferably from 0.2 m to 2.0 m and the grain size distribution may be either homodisperse or heterodisperse. A homodisperse grain size distribution is one in which 95% of the grains differ by not more than ±30% from the average grain size. The emulsions may contain organic silver salts in addition to the silver halide, e.g. silver benzotriazolate or silver behenate.

Two or more types of silver halide emulsions which have been prepared separately may be used as a mixture.

The photographic emulsions may be prepared by various methods from soluble silver salts and soluble halides (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsions, The Focal Press, London (1966)).

Precipitation of the silver halide is preferably carried out in the presence of the binder, e.g. gelatine, and may be carried out in an acid, neutral or alkaline pH, silver halide complex formers being preferably used in addition. The latter include e.g. ammonia, thioethers, imidazole, ammonium thiocyanate and excess halide. The water-soluble silver salts and the halides may be brought together either successively by the single jet process or simultaneously by the double jet process or by any combination of these two processes. Dosing at increasing inflow rates is preferred, but the "critical" inflow rate at which new nuclei are just prevented from forming should not be exceeded. The pAg range may vary within wide limits during precipitation; the so-called pAg controlled process is preferably employed, in which the pAgis kept constant at a particular value or is passed through a particular pAg profile during precipitation. So-called inverse precipitation using an excess of silver ions may also be used in addition to the preferred method of precipitation using an excess of halide. Apart from precipitation, the silver halide crystals may also grow by physical ripening (Ostwald ripening) in the presence of excess halide and/or silver halide complex formers. The growth of the emulsion grains may even take place predominantly by Ostwald ripening, in which case a fine grained, so-called Lippmann emulsion is preferably mixed with a sparingly soluble emulsion and re-dissolved on the latter.

Salts or complexes of metals such as Cd, Zn, Pb, Tl, Bi, Ir, Rh or Fe may be present during precipitation and/or during physical ripening of the silver halide grains.

Precipitation may also be carried out in the presence of sensitising dyes. Complex formers and/or dyes may be rendered inactive at any stage, e.g. by changing the pH or by an oxidative treatment. .

When crystal formation has been completed or at an earlier stage, the soluble salts are removed from the emulsion, e.g. by shredding and washing, by flocculating and washing, by ultrafiltration or by means of ion exchangers.

The silver halide emulsion is generally subjected to a chemical sensitization under specified conditions of pH, pAg, temperature and concentration of gelatine, silver halide and sensitizer until the sensitivity and fogging optimum has been reached. The procedure has been described e.g. in H. Frieser, "Die Grundlagen der Photographischen Prozesse mit Silberhalogeniden" Pages 674–734, Akademische Verlagsgesellschaft (1968).

Chemical sensitization may be carried out with the addition of compounds of sulphur, selenium or tellurium and/or compounds of metals of the VIIIth sub-Group of the Periodic System (e.g. gold, platinum, palladium or iridium) and thiocyanate compounds, surface-active compounds such as thioethers, heterocyclic nitrogen compounds (e.g. imidazoles, azaindenes) or spectral sensitizers (described e.g. in F. Hamer, "The Cyanine Dyes and Related Compounds", 1964, and Ullmanns Encyclopädie der technischen Chemie, 4th Edition, Volume 18, page 431 et seq and Research Disclosure 17643 (December 1978), Chapter III) may also be added. Instead of or in addition to these procedures, a reduction sensitization may be carried out with hydrogen, with the addition of reducing agents (tin-II salts, amines, hydrazines derivatives, aminoboranes, silanes, formamidine sulphinic acid), or by employing a low pAg (e.g. below 5) and/or a high pH (e.g. above 8).

The photographic emulsions may contain compounds for preventing fogging or for stabilizing the photographic function during production, storage or photographic processing.

Azaindenes are particularly suitable, especially tetra- and penta-azaindenes and particularly those which are substituted with hydroxyl or amino groups. Compounds of this type have been described e.g. by Birr in Z. Wiss. Phot. 47 (1952), pages 2–58. Salts of metals such as mercury or cadmium, aromatic sulphonic or sulphinic acids such as benzene sulphinic acid and nitrogen-containing heterocyclic compounds such as nitrobenzimidazole, nitroindazole, substituted or unsubstituted benzotriazoles or benzothiazolium salts may also be used. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines. These mercaptoazoles may also contain a water-solubilizing group, e.g. a carboxyl group or a sulpho group. Other suitable compounds are disclosed in Research Disclosure 17643 (December 1978), Chapter VI.

The stabilizers may be added to the silver halide emulsions before, during or after ripening. The compounds may, of course, also be added to other photographic layers which are associated with a silver halide layer.

Mixtures of two or more of the above-mentioned compounds may be used.

The photographic emulsion layers or other hydrophilic colloid layers of the light-sensitive material produced according to the invention may contain surface-active agents for various purposes such as coating auxiliaries and substances to prevent electric charging, to improve the slip properties, to emulsify the dispersion, to prevent adherence and to improve the photographic characteristics (e.g. development acceleration, high contrast, sensitization, etc.). Apart from naturally occurring surface-active compounds such as saponin, the surface-active compounds used are mainly synthetic compounds (surfactants): non-ionic surfactants, e.g. alkylene oxide compounds, glycerol compounds or glycidol compounds, cationic surfactants, e.g. higher alkylamines, quaternary ammonium salts, pyridine compounds and other heterocyclic compounds, sulphonium compounds or phosphonium compounds, anionic surfactants containing an acid group, e.g. a carboxylic acid, sulphonic acid, phosphoric acid, sulphuric acid ester or phosphoric acid ester group, ampholytic surfactants, e.g. amino acid and aminosulphonic acid compounds and sulphur or phosphoric acid esters of an amino alcohol.

The photographic emulsions may be spectrally sensitized with methine dyes or other dyes. Cyanine dyes, merocyanine dyes and complex merocyanine dyes are particularly suitable dyes.

A survey of polymethine dyes suitable as spectral sensitizers, suitable combinations thereof and combinations which have a supersensitizing action is given in Research Disclosure 17643 (December 1978), Chapter IV.

The following dyes in particular, given in order of the spectral regions, are suitable:

1. As Red Sensitizers 9-ethylcarbocyanines containing benzothiazole, benzoselenazole or naphthothiazole as basic end groups, which may be substituted in the 5- and/or 6-position by halogen, methyl, methoxy, carbalkoxy or aryl, and 9-ethylnaphthoxathia- or selenocarbocyanines and 9-ethyl-naphthothioxa- or -benzimidazocarbocyanines, provided these dyes carry at least one sulphoalkyl group on the heterocyclic nitrogen.

2. As Green Sensitizers

9-Ethylcarbocyanines containing benzoxazole, naphthoxazole or a benzoxazole and a benzothiazole as basic end groups and benzimidazocarbocyanines which may be further substituted and which must also contain at least one sulphoalkyl group on the heterocyclic nitrogen.

2. As Blue Sensitizers symmetric or asymmetric benzimidazo-, oxa-, thia- or selena-cyanines having at least one sulphoalkyl group on the heterocyclic nitrogen and optionally additional substituents on the aromatic nucleus, and apomerocyanines containing a rhodanine group.

Sensitizers can be dispersed with if the intrinsic sensitivity of the silver halide is sufficient for a particular spectral region, for example the blue sensitivity of silver bromides.

Non-diffusible monomeric or polymeric colour couplers are associated with the differently sensitized emulsion layers. These colour couplers may be situated in the layer with which they are associated or in an adjacent layer. Cyan couplers are generally associated with the red-sensitive layers, magenta couplers with the green-sensitive layers and yellow couplers with the blue-sensitive layers.

Colour couplers for producing the cyan partial colour image are generally couplers of the phenol or α-naphthol series.

Colour couplers for producing the magenta partial colour image are generally couplers of the 5-pyrazolone, the indazolone or the pyrazoloazole series.

Colour couplers for producing the yellow partial colour image are generally couplers containing an open chain ketomethylene group, in particularly couplers of the α-acylacetamide series; suitable examples of these are α-benzoylacetanilide couplers and α-pivaloylacetanilide couplers.

The colour couplers may be 4-equivalent couplers or they may be 2-equivalent couplers. The latter are derived from 4-equivalent couplers in that they contain in the coupling position a substituent which is split off in the coupling reaction. 2-Equivalent couplers include colourless couplers as well as couplers which have an intense colour of their own which disappears in the process of colour coupling and may be replaced by the colour of the image dye produced (masking couplers), and white couplers which give rise to substantially colourless products in the reaction with colour developer oxidation products. The 2-equivalent couplers also include couplers which contain in the coupling position a removable group which is released in the reaction with colour developer oxidation products to develop a particular desired photographic activity, e.g. as development inhibitor or accelerator, either directly or after one or more further groups have been split off from the group originally split off (e.g. DE-A-27 03 145, DE-A-28 55 697, DE-A- 31 05 026, DE-A-33 19 428). Examples of such 2-equivalent couplers are the known DIR-couplers as well as DAR- and FAR-couplers.

DIR-couplers which release development inhibitors of the azole series such as triazoles and benzotriazoles are described in DE-A-24 14 006, 26 10 546, 26 59 417, 27 54 281, 28 42 063, 36 26 219, 36 30 564, 36 36 824 and 36 44 416. Other advantages for colour reproduction, i.e. colour separation and colour purity, and for rendering of detail, i.e. sharpness and graininess, can be obtained with DIR-couplers which, for example, do not release the development inhibitor immediately as a result of coupling with an oxidized colour developer but only after a further secondary reaction which is obtained, for example, by means of a time control group. Examples of such couplers are described in DE-A- 28 55 697, 32 99 671, 38 18 231 and 35 18 797, in EP-A-0 157 146 and 0 204 175, in U.S. Pat. Nos. 4,146,396 and 4,438,393 and in GB-A-2 072 363.

DIR-Couplers which release a development inhibitor which decomposes in a developer bath to photographically substantially inactive products are described, for example, in DE-A-32 09 486 and in EP-A-0 167 168 and 0 219 713. This measure gives rise to trouble-free development and constancy of processing.

When DIR-couplers are used, in particular those which split off a readily diffusible development inhibitor, improvements in colour reproduction, e.g. more highly differentiated colour reproduction, can be achieved if suitable measures are taken in the process of optical sensitization as described, for example, in E-A- 0 115 304 and 0 167 173, GB-A-2 165 058, DE-A-37 00 419 and U.S. Pat. No. 4,707,436.

The DIR-couplers may be added to a wide variety of layers of a multilayered photographic material, e.g. even to light-insensitive layers or interlayers, but they are preferably added to the light-sensitive silver halide emulsion layers in which the characteristic properties of the silver halide emulsion, e.g. the iodide content, the structure of the silver halide grains or their grain size distribution influence the photographic properties obtained. The influence of the released inhibitors may be limited, for example by the incorporation of an inhibitor acceptor layer according to DE-A-24 31 223. For reasons of reactivity or stability it may be advantageous to use a DIR coupler which, when coupling takes place, gives rise to a colour which is different from the colour to be produced in the layer in which it is situated.

An increase in sensitivity, contrast and maximum density can be achieved in particular by using DAR- or FAR-couplers which split off a development accelerator or a foggant. Compounds of this type are described, for example, in DE-A-25 34 466, 32 09 110, 33 33 355, 34 10 616, 34 29 545 and 34 41 823, in EP-A-0089 834, 0 110 511, 0 118 087 and 0 147 765 and in U.S. Pat. Nos. 4,618,572 and 4,656, 123.

For an example of using BAR-couplers (bleach accelerator releasing coupler), see EP-A-193 389.

It may be advantageous to modify the action of a photographically active group split off from a coupler by bringing about an intermolecular reaction of this group with another group after its release as described in DE-A-35 06 805.

Since DIR-, DAR- and FAR-couplers are mainly required for the activity of the radical released in the coupling reaction and the colour producing properties of these couplers is less important, those DIR-, DAR- and FAR-couplers which give rise to substantially colourless products in the coupling reaction are also suitable (DE-A-15 47 640).

The removable group may be a ballast group so that the reaction with colour developer oxidation products gives rise to coupling products which are diffusible or at least have a slight or limited mobility (U.S. Pat. No. 4,420,556).

The material may also contain compounds which are not couplers but are also capable of releasing, for example, a development inhibitor, a development accelerator, a bleaching accelerator, a developer, a silver halide solvent, a foggant or an anti-foggant, for example, so-called DIR-hydroquinones and other compounds described, for example, in U.S. Pat. Nos. 4,636,546, 4,345,024 and 4,684,604 and in DE-A-31 45 640, 25 15 213 and 24 47 079 and in EP-A-198 438. These compounds fulfill the same function as the DIR-, DAR- or FAR-couplers except that they form no coupling products.

High molecular weight colour couplers are described, for example, in DE-C- 1 297 417, DE-A-24 07 569, DE-A-31 48 125, DE-A-32 17 200, DE-A- 33 20 079, DE-A-33 24 932, DE-A-33 31 743, DE-A-33 40 376, EP-A-27 284 and U.S. Pat. No. 4,080,211. The high molecular weight colour couplers are generally produced by the polymerisation of ethylenically unsaturated monomeric colour couplers but they may also be obtained by polyaddition or polycondensation.

The couplers or other compounds may be incorporated in silver halide emulsion layers by first preparing a solution, dispersion or emulsion of the particular compound and then adding this to the casting solution for the particular layer. The choice of suitable solvent or dispersing agent depends on the solubility of the compound.

Methods for introducing compounds which are substantially insoluble in water by employing grinding processes are described, for example, in DE-A-26 09 741 and DE-A-26 09 742.

Hydrophobic compounds may also be introduced into the casting solution by using high boiling solvents, so-called oil formers. Suitable methods are described, for example in U.S. Pat. No. 2,322,027, U.S. Pat. No. 2,801,170, U.S. Pat. No. 2,801,171 and EP-A- 0 043 037.

Oligomeric or polymeric oil formers referred to as polymeric oil formers may be used instead of the high boiling solvents.

The compounds may also be introduced into the casting solution in the form of charged latices; see, for example, DE-A-25 41 230, DE-A-25 41 274, DE-A- 28 35 856, EP-A-0 014 921, EP-A-0 069 671, EP-A-0 130 115 and U.S. Pat. No. 4,291,113.

The diffusion-fast incorporation of anionic water-soluble compounds (e.g. dyes) may also be carried out with the aid of cationic polymers, so-called mordant polymers.

Examples of suitable oil formers include phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

The following are specific examples of suitable oil formers: Dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl-p-hydroxy-benzoate, diethyl dodecanamide, N-tetradecylpyrolidone, isostearyl alcohol, 2,4-di-p-amylphenol, dioctyl acetate, glycerol tributyrate, isostearyl lactate, trioctyl citrate, N,N-dibutyl- 2-butoxy-5-t-octylaniline, paraffin, dodecyl benzene and diisopropylnaphthalene.

Each of the differently sensitized light-sensitive layers may consist of a single layer or of two or more silver halide emulsion partial layers (DE-C-1 121 470). Red-sensitive silver halide emulsion layers are frequently arranged closer to the layer support than green-sensitive silver halide emulsion layer, which in turn are arranged closer to the support than blue-sensitive layers and a light-insentitive yellow filter layer is generally situated between the green-sensitive layers and the blue-sensitive layers.

If the green-sensitive or red-sensitive layers have a suitable slight intrinsic sensitivity, the yellow filter layer may be dispensed with and other layer arrangements may be chosen in which, for example, the blue-sensitive layer is arranged closest to the support, followed by the red-sensitive and finally the green-sensitive layers.

The light-insensitive interlayers generally arranged between layers different in spectral sensitivity may contain agents which prevent unwanted diffusion of developer oxidation products from one light-sensitive layer into another light-sensitive layer which has a different spectral sensitization.

Suitable agents, also known as scavengers or EOP acceptors, are described in Research Disclosure 17 643 (December 1978), Chapter VII, 17 842 (February 1979) and 18 716 (November 1979), page 650 and in EP-A-0 069 070, 0 098 072, 0 124 877 and 0 125 522.

When the photographic material contains several partial layers of the same spectral sensitization, these may differ in their composition, in particular in the nature and quantity of the silver halide grains. The partial layer having the higher sensitivity is generally arranged further away from the support than the partial layer having the lower sensitivity. Partial layers having the same spectral sensitization may be adjacent to one another or they may be separated by other layers, e.g. by layers having a different spectral sensitization. Thus, for example, all high sensitivity layers may be combined to form one layer packet and all low sensitivity layers may be combined to form another layer packet (DE-A-19 58 709, DE-A- 25 30 645 and DE-A-26 22 922).

The photographic material may also contain UV light absorbent compounds, white toners, spacers, filter dyes, formalin acceptors, light-protective agents, antioxidants, $D_{min}$ dyes, additives for improving the stabilisation of the dyes, couplers and whites and compounds for improving the colour fog, plasticisers (latices), biocides, etc. . . .

UV-Light absorbent compounds should on the one hand protect the image dyes against bleaching by daylight rich in UV light and on the other hand act as filter dyes to absorb the UV light in daylight when exposure takes place in order to improve the colour reproduction of the film. Compounds differing in structure are generally used for the two different functions. Examples include aryl substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Couplers which absorb ultraviolet light (such as cyan couplers of the α-naphthol series) and ultraviolet absorbing polymers may also be used. These ultraviolet absorbents may be fixed in a particular layer by mordants.

Filter dyes suitable for visible light include oxonole dyes, hemi-oxonole dyes, styryl dyes, merocyanine dyes, cyanine dyes and azo dyes. Among these dyes, oxonole dyes, hemi-oxonole dyes and merocyanine dyes are particularly advantageous.

Suitable white toners are described e.g. in Research Disclosure 17 643 (December 1978), Chapter V, in U.S. Pat. Nos. 2,632,701 and 3,269,840 and in GB-A-852 075 and 1 319 763.

Certain layers of binders, in particular those furthest removed from the support but occasionally also interlayers, in particular if these were furthest removed from the support during preparation of the material, may contain photographically inert particles of an inorganic or organic nature, e.g. as matting agents or as spacers (DE-A-33 542, DE-A-34 24 893 and Research Disclosure 17643, December 1978), Chapter XVI).

The average particle diameter of the spacers is mainly in the range of from 0.2 to 10 μm. The spacers are insoluble in water and may be soluble or insoluble in alkalies. Those which are soluble in alkalies generally get removed from the photographic material in the alkaline development bath. Examples of suitable polymers include polymethyl methacrylate, copolymers of acrylic acid and methyl methacrylate, and hydroxypropyl methyl cellulose hexahydrophthalate.

Additives for improving the stability of the dyes, couplers and whites and for reducing the colour fog (Research Disclosure 17643 (December 1978), Chapter VII) may belong to the following classes of chemical substances: Hydroquinones, 6-hydroxychromans, 5-hydroxychromans, spirochromans, spiroindanes, p-alkoxyphenols, sterically hindered phenols, gallic acid derivatives, methylene dioxybenzenes, aminophenols, sterically hindered amines and derivatives containing esterified or etherified phenolic hydroxyl groups, and metal complexes.

Compounds which contain both a sterically hindered amine partial structure and a sterically hindered phenol partial structure and a sterically hindered phenol partial structure in one and the same molecule (U.S. Pat. No. 4,268,593) are particularly effective in preventing any impairment of yellow colour images as a result of the development of heat, moisture and light. Sproindanes (JP-A-159 644/81) and chromans substituted by hydrochinone diethers or monoethers (JP-A-89 835/80) are particularly effective in preventing impairment of magenta colour images, in particular due to the action of light.

Colour photographic negative materials are normally processed by development, bleaching, fixing and washing or by development, bleaching, fixing and stabilization without subsequent washing, and bleaching and fixing may be combined in one process step. The colour developer compounds used may be any developer compounds which are capable in the form of their oxidation product of reacting with colour couplers to form azomethine or indophenol dyes. Suitable colour developer compounds include aromatic compounds of the p-phenylenediamine series containing at least one primary amino group, e.g. N,N-dialkyl-p-phenylenediamines such as N,N-diethyl-p-phenylenediamine, 1-(N-ethyl-N-methanesulphonamidoethyl)- 3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other suitable colour developers are described, for example, in J. Amer. Chem. Soc. 73, 3106 (1951) and G. Haist, Modern Photographic Processing, 1979, John Wiley and Sons, New York, page 545 et seq.

Colour development may be followed by a short stop bath or by washing.

The material is normally bleached and fixed immediately after colour development. Suitable bleaching agents, are, for example, Fe(III) salts and Fe(III) complex salts such as ferricyanines, dichromates and water-soluble cobalt complexes. Iron-(III) complexes of aminopolycarboxylic acids are particularly preferred, in particular, for example, the iron-(III) complexes of ethylendiaminotetracetic acid, propylene diaminotetracetic acid, diethylenetriaminopentacetic acid, nitrilotriacetic acid, iminodiacetic acid, N-hydroxyethyl-ethylenediaminotriacetic acid and alkyliminodicarboxylic acids and of phosphonic acids. Persulphates and peroxides are also suitable bleaching agents, e.g. hydrogen peroxides.

The bleach fixing bath or fixing bath is in most cases followed by washing, which is carried out as a counterflow washing or in several tanks each with its own water supply.

Advantageous results may be obtained by following this with a final bath containing little or no formaldehyde.

Washing may be completely replaced by a stabilizing bath, which is normally carried out in countercurrent. This stabilizing bath also functions as final bath when formaldehyde is added.

In colour reversal materials, development with a black-and-white developer whose oxidation product is not capable of reacting with the colour couplers is first carried out and this is followed by a diffuse second exposure which in turn is followed by development with a colour developer, bleaching and fixing.

EXAMPLE 1

A colour photographic recording material was prepared by applying the following layers in the sequence given to a paper which was coated with polyethylene on both sides. The quantities given are based on 1 $m^2$. The silver halide applied is stated in terms of the corresponding quantities of $AgNO_3$.

Layer Arrangement 1.1

(Comparison)

1st Layer (Subbing Layer)
0.2 g of gelatine
2nd Layer (Blue-Sensitive Layer)
Blue sensitive silver halide emulsion (99.5 mol-% chloride, 0.5 mol-% bromide, average grain diameter 0.78 μm) from 0.50 g of $AgNO_3$ with
1.38 g of gelatine,
0.60 g of Yellow coupler Y-1 and
0.48 g of tricresylphosphate (TCP)
3rd Layer (Interlayer)
1.18 g of gelatine,
0.08 g of 2,5-dioctylhydroquinone and
0.08 g of dibutylphthalate (DBP)
4th Layer (Green-Sensitive Layer)
green sensitized silver halide emulsion (99.5 mol-% chloride, 0.5 mol-% bromide, average grain diameter 0.37 μm) from 0.40 g of $AgNO_3$ with
1.02 g of gelatine,
0.37 g of magenta coupler M-1 and
0.40 g of DBP
5th Layer (Interlayer)
1.20 g of gelatine,
0.66 g of UV absorbent corresponding to the following formula

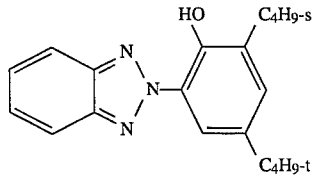

0.052 g of 2,5-dioctylhydroquinone and 0.36 g of TCP

6th Layer (Red Sensitive Layer)

red-sensitized silver halide emulsion (99.5 mol-% chloride, 0.5 mol-% bromide, average grain diameter 0.35 μm) from 0.28 g of $AgNO_3$ with 0.84 g of gelatine, 0.39 g of cyan coupler C-1 and 0.39 g of TCP 7th Layer (UV Protective Layer)

0.65 g of gelatine, 0.21 of UV absorbent as in 5th Layer and 0.11 g of TCP

8th Layer (Protective Layer)

0.65 g of gelatine, 0.39 g of hardener corresponding to the following formula

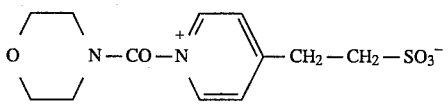

Y-1

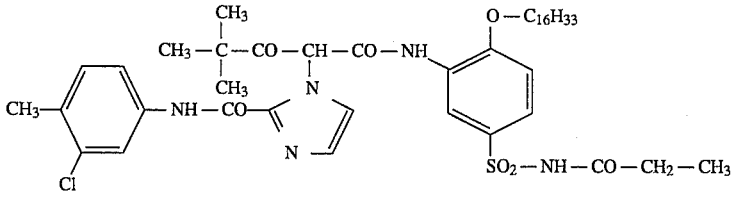

C-1

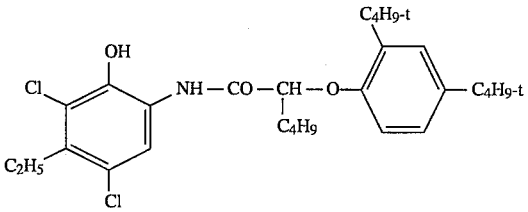

M-1

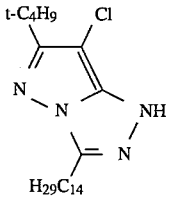

Layer Arrangement 1.2

(Comparison)

Same as layer arrangement 1.1 but with different quantities of gelatine and an additional polymer:

1st Layer 0.18 g of gelatine and 0.02 g of polyvinyl alcohol

2nd Layer 1.24 g of gelatine and 0.14 g of polyvinyl alcohol

3rd Layer 1.06 g of gelatine and 0.12 g of polyvinyl alcohol 4th Layer 0.92 of gelatine and 0.1 g of polyvinyl alcohol 6th Layer 0.76 g of gelatine and 0.08 g of polyvinyl alcohol 7th Layer 0.56 g of gelatine and 0.09 of polyvinyl alcohol 8th Layer 0.56 g of gelatine and 0.09 g of polyvinyl alcohol Layer Arrangement 1.3

(Comparison)

Same as Layer arrangement 1.2 but with the following differences:

The polyvinyl alcohol is replaced in all layers by the same quantity of a block copolymer of polyvinyl alcohol/polyacrylic acid according to U.S. Pat. No. 4,912,023 (Comparison polymer A1).

Layer Arrangement 1.4

(According to the Invention)

Same as Layer arrangement 1.2 but with the following differences:

The polyvinyl alcohol is replaced in all the layers by an equal quantity of Polymer P-3.

Layer Arrangement 1.5

(According to the Invention)

Same as Layer arrangement 1.2 but with the following differences:

The polyvinyl alcohol is replaced in all the layers by an equal quantity of Polymer P-8.

Layer arrangement 1.6

(According to the Invention)

Same as Layer arrangement 1.1 but with different quantities of gelatine and additional polymer:

1st Layer 0.16 g of gelatine and 0.04 g of Polymer P-4

2nd Layer 1.10 g of gelatine and 0.28 g of Polymer P-4
3rd Layer
0.94 g of gelatine and
0.24 g of Polymer P-4
4th Layer
0.82 g of gelatine and
0.20 g of Polymer P-4
5th Layer
0.96 of gelatine and
0.24 g, of Polymer P-4
6th Layer
0.67 g of gelatine and
0.17 g of Polymer P-4
7th Layer
0.52 g of gelatine and
0.13 g of Polymer P-4
8th Layer
0.52 g of gelatine and
0.13 g of Polymer P-4

Layer Arrangement 1.7

(According to the Invention)

Same as layer arrangement 1.6 but with the following differences:

Polymer P-4 is replaced in all layers by an equal quantity of Polymer P-5.

The layer arrangements were subsequently exposed behind a graduated grey wedge. The materials were then processed in the usual manner with the processing baths indicated below.

| | | |
|---|---|---|
| a) | Colour developer - 45 s - 35° C. | |
| | Triethanolamine | 9.0 g/l |
| | N,N-Diethylhydroxylamine | 4.0 g/l |
| | Diethylene glycol | 0.05 g/l |
| | 3-Methyl-4-amino-N-ethyl-N-methane-sulphonamidoethyl-aniline sulphate | 5.0 g/l |
| | Potassium sulphite | 0.2 g/l |
| | Triethylene glycol | 0.05 g/l |
| | Potassium carbonate | 22 g/l |
| | Potassium hydroxide | 0.4 g/l |
| | Ethylene diaminotetracetic acid, disodium salt | 2.2 g/l |
| | Potassium chloride | 2.g g/l |
| | 1,2-Dihydroxybenzene-3,4,6-trisulphonic acid, trisodium salt | 0.3 g/l |
| | made up with water to 1000 ml; pH 10.0 | |
| b) | Bleach fixing bath - 45 s - 35° C. | |
| | Ammonium thiosulphate | 75 g/l |
| | Sodium hydrogen sulphite | 13.5 g/l |
| | Ammonium acetate | 2.0 g/l |
| | Ethylene diaminotetracetic acid (iron ammonium salt) | 57 g/l |
| | ammonia 25% by weight | 9.5 g/l |
| | Acetic acid | 9.0 g/l |
| | made up with water to 1000 ml; pH 5.5 | |
| c) | Washing - 2 min - 35° C. | |
| d) | Drying | |

The wet scratch resistance of samples of the processed material was determined by the following method:

The photographic recording materials are placed with their layer side upwards on a horizontal sample holder in a vat filled with water of 10° DH and 38° C. The sample to be measured is completely covered with water. After a swelling time of 5 minutes, a firmly held steel ball (Ø 3.2 mm) is passed over the surface of the sample at a rate of v=30 mm/sec. The force (in N) with which the aforesaid steel ball presses on the outermost protective layer of the sample is adjusted so that it continuously rises from 0 to 10 N over a measuring path of 20 cm.

The wet scratch resistance of the photographic recording material (in N) is given in terms of the force at which the first damage to the layer along the measuring path can be detected by the human eye after the sample has dried.

In addition, the layer arrangements are observed under obliquely incident light and the layers were assessed visually for their gloss (Table 1).

The swelling factor of the samples is also determined as a measure of the degree of cross-linking:

$$\text{Swelling factor } QF = \frac{\text{Layer thickness wet}}{\text{Layer thickness dry}}$$

TABLE 1

| Layer arrangement | Wet scratch resistance in N | Gloss | Swelling factor |
|---|---|---|---|
| 1.1 (Comparison) | 4.8 | clear | 3.3 |
| 1.2 (Comparison | 4.7 | matt | 4.6 |
| 1.3 (Comparison) | 3.8 | clear | 3.6 |
| 1.4 according to the invention | 5.4 | clear | 2.8 |
| 1.5 according to the invention | 5.6 | clear | 2.7 |
| 1.6 according to the invention | 5.6 | clear | 2.7 |
| 1.7 according to the invention | 5.5 | clear | 2.8 |

Table 1 shows that photographic materials which have been hardened with an instant hardener and contain the polymers according to the invention have improved mechanical properties as expressed by their wet scratch resistance and the swelling factor. Further, the addition of CO-PVA does not deleteriously affect the gloss of the materials.

EXAMPLE 2

A colour photographic recording material was prepared as described in Example 1.

Layer Arrangement 2.1

(Comparison)

Same as Layer arrangement 1.1.

Layer Arrangement 2.2

(Comparison)

Same as Layer arrangement 2.1 but with different quantities of gelatine and additional polymer:

Layer 3
1.12 g of gelatine and
1.18 g of polyvinyl alcohol
Layer 5
1.12 g of gelatine and
1.18 g of polyvinyl alcohol Layer Arrangement 2.3

(Comparison)

Same as Layer arrangement 2.2 but with the polyvinyl alcohol in Layer 3 and Layer 5 replaced by an equal quantity of A1.

Layer Arrangement 2.4

(According to the Invention)

Same as Layer arrangement 2.2 but with the following differences:

The polyvinyl alcohol in Layer 3 and Layer 5 is replaced by an equal quantity of Polymer P-3.

Layer Arrangement 2.5

(According to the Invention)

Same as Layer arrangement 2.2 but with the following differences:

The polyvinyl alcohol in Layer 3 and Layer 5 is replaced by an equal quantity of Polymer P-4.

Layer Arrangement 2.6

(According to the Invention)

Same as Layer arrangement 2.2 but with the following differences:

The polyvinyl alcohol in Layer 3 and Layer 5 is replaced by an equal quantity of Polymer P-5.

Layer Arrangement 2.7

(According to the Invention)

Same as Layer arrangement 2.2 but with the following differences:

The polyvinyl alcohol in Layer 3 and Layer 5 is replaced by an equal quantity of Polymer P-7.

Layer Arrangement 2.8

(Comparison)

Same as Layer arrangement 2.1 but with different quantities of gelatine and with additional polymer:

Layer 1
0.1 g of gelatine and
0.1 g of A-1
Layer 3
1.1 g of gelatine and
1.1 g of A-1
Layer 4
0.6 g of gelatine and
0.4 g, of A-1
Layer 5
1.1 g of gelatine and
1.1 g of A-1
Layer 7
0.55 g of gelatine and
0.10 g of A-1
Layer 8
0.52 g of gelatine and
0.13 g of A-1

Layer Arrangement 2.9

(According to the Invention)

Same as Layer arrangement 2.8 but with the following differences:

A-1 replaced in all layers by equal quantities of Polymer P-4.

Layer Arrangement 2.10

(According to the Invention)

Same as Layer arrangement 2.8 but with the following differences:

A-1 in al layers replaced by equal quantities of Polymer P-5.

Layer Arrangement 2.11

(According to the Invention)

Same as Layer arrangement 2.8 but with the following differences:

A-1 in all layers replaced by equal quantities of Polymer P-7.

The layer arrangements were processed as in Example 1.

The processed samples were exposed to the light of a Xenon lamp which had been standardised to daylight and the samples were exposed for $4.2\times10^6$ Lux hours. The percentage decrease in density was then measured, given an initial density of 1.5.

In addition, the wet scratch resistance, swelling factor and gloss of the samples were determined as in Example 1. The results are summarized in Table 2.

TABLE 2

| Layer arrangement | Density decrease in % after $4.2 \cdot 10^6$ lux · h | Gloss | Wet scratch resistance in N | Swelling factor |
|---|---|---|---|---|
| 2.1 (Comparison) | 77 | clear | 4.7 | 3.3 |
| 2.2 (Comparison) | 20 | matt | 4.2 | 3.8 |
| 2.3 (Comparison) | 22 | clear | 3.9 | 4.0 |
| 2.4 (according to the invention) | 18 | clear | 5.4 | 3.0 |
| 2.5 (according to the invention) | 20 | clear | 5.6 | 3.1 |
| 2.6 (according to the invention) | 17 | clear | 5.6 | 2.9 |
| 2.7 (according to the invention) | 19 | clear | 5.3 | 3.1 |
| 2.8 (comparison) | 20 | clear | 3.8 | 4.2 |
| 2.9 (according to the invention) | 19 | clear | 5.7 | 2.8 |
| 2.10 (according to the invention) | 17 | clear | 5.5 | 2.7 |
| 2.11 (according to the invention) | 18 | clear | 5.5 | 2.8 |

Example 2 shows that the combination of instant hardeners with the amino-functional polyvinyl alcohols gives rise both to mechanically stable layers and to light stable materials.

EXAMPLE 3

A colour photographic recording material was prepared according to Example 1.

Layer Arrangement 3.1 (Comparison)

Same as layer arrangement 1.1.

Layer Arrangement 3.2 (According to the Invention)

Same as layer arrangement 3.1 but with the following differences:

1st Layer
0.4 g of Polymer P-7 instead of gelatine
5th Layer
1.2 g of Polymer P-5 instead of gelatine.

Layer Arrangement 3.3

(According to the Invention)

Same as layer arrangement 3.1 but with the following differences:

3rd Layer and 5th Layer:
0.6 g of Polymer P-1 and
0.6 g of polyacrylic acid ($M_w$=60,000) instead of gelatine.

The layer arrangements were processed as in Example 1.

The processed samples were exposed to the light of a Xenon lamp which had been standardised to daylight and the samples were exposed for $4.2\times10^6$ lux.h. The percentage decrease in density was then measured, given an initial density of 1.5. The results are summarised in Table 3.

TABLE 3

| Layer arrangement | Density decrease in % after $4.2 \cdot 10^6$ Lux · H |
|---|---|
| 3.1 (Comparison) | 76 |
| 3.2 (according to the invention) | 32 |
| 3.3 (according to the invention) | 21 |

EXAMPLE 4

A colour photographic recording material was prepared according to Example 1.

Layer Arrangements 4.1 to 4.3

(Comparison)

Same as layer arrangement 1.1 but with the following differences:

4th Layer
0.3 g of dyestuff stabiliser according to Table 4 were added.

Layer Arrangements 4.4 to 4.6

(According to the Invention)

Same as layer arrangement 1.1 but with the following differences:

4th Layer
0.3 g of dyestuff stabiliser according to Table 4 were added.
3rd and 5th layer:
0.6 g of gelatine
1.1 g of polymer according to Table 4.

The samples were processed as in Example 1.

The processed samples were exposed to the light of a Xenonlamp which had been standardised to daylight for $10\times10^6$ Lux hours. The percentage decrease in densing was then measured. The results are summarized in Table 4.

Table 4 shows that by the addition of the polymers according to the invention the light stability of the dyestuff stabilised with a dyestuff stabiliser is further improved.

TABLE 4

| Layer arrangement | Polymer | Dyestuff stabiliser | Density decrease in % after $10.10^6$ lux · h at density 1.0 | density 1.5 |
|---|---|---|---|---|
| 4.1 | — | ST-I-1 | 64 | 31 |
| 4.2 | — | ST-II-1 | 75 | 43 |
| 4.3 | — | St-II-1/St-III-2 (1:1) | 59 | 30 |
| 4.4 | P3 | St-I-1 | 32 | 21 |
| 4.5 | P3 | ST-II-1 | 36 | 22 |
| 4.6 | P5 | ST-II-1St-III-2 (1:1) | 28 | 28 |

EXAMPLE 5

Gelatinous model layers were coated wherein 15% by weight of the total dry substance consisted of a polymer according to the invention wherein the polyvinylalcohol moiety was 66% by weight and the polyvinyl alcohol moiety modified with amino-acetaldehyde-dimethylacetal was 34% by weight. The hardening was performed by means of methylenebisvinylsulphon with varying concentrations. Corresponding control samples consisting of pure gelatin and hardener were also coated. All layers were coated at a coverage of 5.0 g/m$^2$ of total dry substance. Details of the composition are summarized in Table 5.1:

TABLE 5.1

| Sample No. | % of gelatin | % of polymer | amount of hardener (meq.*/g dry substance) |
|---|---|---|---|
| 5.1 | 100 | 0 | 0.10 |
| 5.2 | 100 | 0 | 0.15 |
| 5.3 | 100 | 0 | 0.30 |
| 5.4 | 85 | 15 | 0.10 |
| 5.5 | 85 | 15 | 0.15 |
| 5.6 | 85 | 15 | 0.30 |

*meq. stands for milliequivalents

For each sample the water take-up was measured at 24° C. and the swelling ratio (wet thickness to dry thickness) was calculated. The scratch resistance values were determined. The results of these physical measurements are represented in Table 5.2:

TABLE 5.2

| Sample No. | water take-up (g/m$^2$) | swelling ratio | scratch resistance |
|---|---|---|---|
| 5.1 | 10.11 | 2.73 | 600 |
| 5.2 | 8.62 | 2.47 | 1100 |
| 5.3 | 7.31 | 2.21 | 1200 |
| 5.4 | 7.72 | 2.26 | 1150 |
| 5.5 | 6.61 | 2.12 | 1400 |
| 5.6 | 5.78 | 1.97 | >1600 |

When comparing the results of the control samples 5.1 to 5.3 with the respective invention samples 5.4 to 5.6 it is clear that a higher scratch resistance and a lower swelling ratio, illustrative for a better hardening, is obtained with the gelatinous layers containing a polymer according to the invention.

We claim:

1. A photographic silver halide material comprising at least one light-sensitive silver halide layer and contains, in at least one layer, a compound corresponding to formula (I) in a quantity of at least 10 mg/m$^2$:

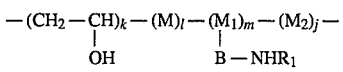

(I)

where k stands for 50 to 99% by weight l denotes 0 to 49% by weight, m denotes 1 to 40% by weight, and j denotes 0 to 49% by weight, M denotes a comonomer incorporated by polymerization, $M_1$ stands for $—CH_2CR_2—$ or

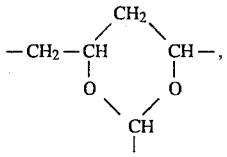

$M_2$ denotes

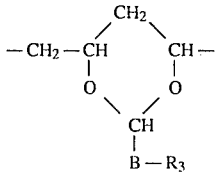

$R_1$ and $R_2$ are the same or different and denote hydrogen or alkyl and $R_3$ denotes an acidic group, B denotes a chemical bond or a bridging member of the formula $$—L_1—(L_2)_n—(L_3)_o—$$

wherein $L_1$ and $L_3$ are identical or different and stand for an alkylene, arylene or aralkylene group having a maximum of 18 carbon atoms, $L_2$ denotes COO, OC—O, CO—NH, NH—CO, $SO_2$—NH, NH—$SO_2$, NH—CO—O or NH—CO—NH and n and o are the same and stand for 0 or 1 and $L_1$ is directly attached to $M_1$, said material being hardened with a rapid or an instant hardener.

2. A photographic silver halide material according to claim 1, which is hardened with an instant hardener of the following formula

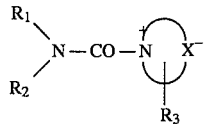

(a)

where $R_1$ denotes alkyl, aryl or aralkyl, $R_2$ has the same meaning as $R_1$ or denotes a compound having two bonds a first and second bond, wherein said compound is selected from the group consisting of alkylene, arylene, arallcylene and alkaralkylene, and the first bond is linked to nitrogen in formula (a) and the second bond is linked to a group of the following formula (b)

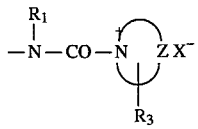

or $R_1$ and $R_2$ together denotes the atoms required for completing an unsubstituted heterocyclic ring or heterocyclic ring substituted with $C_1$-$C_3$-alkyl or halogen, $R_3$ stands for hydrogen, alkyl, aryl, alkoxy, $NR_4$—$COR_5$, —$(CH_2)_m$—$NR_8R_9$, —$(CH_2)_n$—$CONR_{13}R_{14}$ or

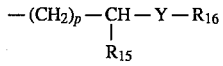

or a bridging member or a direct link to a polymer chain, $R_4$, $R_6$, $R_7$, $R_9$, $R_{14}$, $R_{15}$, $R_{17}$, $R_{18}$ and $R_{19}$ are the same or different and denote hydrogen or $C_1$-$C_4$-alkyl, $R_5$ denotes hydrogen, $C_1$-$C_4$-alkyl or $NR_6R_7$, $R_8$ denotes $COR_{10}$, $R_{10}$ denotes $NR_{11}R_{12}$, $R_{11}$ denotes $C_1$-$C_4$-alkyl or aryl, $R_{12}$ denotes hydrogen, $C_1$-$C_4$-alkyl or aryl, $R_{13}$ denotes hydrogen, $C_1$-$C_4$-alkyl or aryl, $R_{16}$ denotes hydrogen, $C_1$-$C_4$-alkyl, $COR_{18}$ or $CONHR_{19}$, while m stands for a number from 1 to 3, n stands for a number from 0 to 3, p stands for a number from 2 to 3 and Y stands for O or $NR_{17}$ or $R_{13}$ and $R_{14}$ together denote the atoms required for completing a heterocyclic ring, Z denotes the carbon atoms required for completing a 5-membered or 6-membered aromatic heterocyclic ring optionally with condensed benzene ring attached and $X^{\ominus}$ denotes an anion, which is absent when an anionic group is already linked to the remainder of the molecule.

3. The photographic silver halide material as claimed in claim 2, wherein $R_1$ and $R_2$ together denote atoms required for completing an unsubstituted heterocyclic ring, or substituted heterocyclic ring selected from the group consisting of unsubstituted piperidine, piperidine substituted with $C_1$-$C_3$-alkyl or halogen, unsubstituted piperazine, piperazine substituted with $C_1$-$C_3$-alkyl or halogen, unsubstituted morpholine ring and morpholine ring substituted with $C_1$-$C_3$-alkyl or halogen, and $R_{13}$ and $R_{14}$ together denote the atoms required for completing an unsubstituted or substituted heterocyclic ring selected from the group consisting of piperidine, piperidine substituted with $C_1$-$C_3$-alkyl or halogen, piperazine, piperazine substituted with $C_1$-$C_3$ -alkyl or halogen, unsubstituted morpholine ring and morpholine substituted with $C_1$-$C_3$ -alkyl or halogen.

4. The silver halide material as claimed in claim 3, wherein $R_{11}$, $R_{12}$ and $R_{13}$ are phenyl.

5. The photographic silver halide material as claimed in claim 2, further comprising a stabilizer selected from the group consisting of St-I

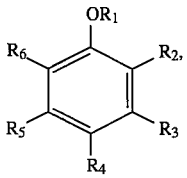

St-II

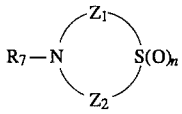

St-III,

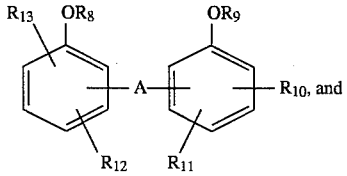

ST-IV or a compound to reduce fog selected from the group consisting of

St-VII

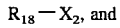

St-VIII

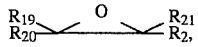

$R_1$, $R_8$ and $R_9$ are the same or different and denote H, alkyl, aryl or a group being split off under alkalinic conditions, $R_2$, $R_3$ and $R_4$ are the same or different and denote —COOH, —$SO_3H$, —$SO_2H$, alkyl, aryl, acyl, alkylsulfonyl, arylsulfonyl, alkenyl, sulfamoyl, acylamino, alkythio, arylthio, ureido, cycloalkyl, carbamoyl, carbamoyloxy or a alkoxycarbonylamino, or $R_3$ and $R_4$ stand together with the atoms of the phenyl ring to which they are linked to form a 5 to 6-membered carbocyclic ring, $R_5$ and $R_6$ are the same or different and denote OH, $OR_1$ or $R_2$, $R_7$ are the same or different and denotes unsubstituted aryl or aryl substituted with OH, $OR_1$, $R_2$, alkoxy carbonyl or dialkyl amino, $R_{10}$, $R_{11}$, $R_{12}$, and $R_{13}$ are the same or different and denote OH, $OR_1$, $R_2$, alkoxycarbonyl, dialkylamino, alkoxycarbonyloxy or halogen, $R_{14}$ denotes alkyl, cycloalkyl, aryl or alkenyl, $R_{15}$ denotes H, acyl, carbomoyl, alkoxycarbonyl or $R_{14}$, $R_{16}$, $R_{17}$ and $R_{18}$ are the same or different and denote alkyl, cycloalkyl, alkenyl, alkinyl, aryl or heterocyclyl, $R_{19}$, $R_{20}$ and $R_{21}$ and $R_{22}$ are the same or different and denote H, alkyl, aryl, alkoxycarbonyl, aryloxycarbonyl or a carbamoyl, wherein the sum of the carbon atoms of $R_{19}$, $R_{20}$, $R_{21}$ and $R_{22}$ is at least 8 and two of $R_{19}$, $R_{20}$, $R_{21}$ and $R_{22}$ may stand together for a 5- to 7-membered ring, $Z_1$ and $Z_2$ are the same or different and denote unsubstituted $C_1$-$C_3$-alkylene or $C_1$-$C_3$-alkylene substituted with OH, $OR_1$, $R_2$, alkoxycarbonyl, dialkylamino or an alkoxycarbonyloxy, wherein the sum of the carbon atoms in the alkylene chains of $Z_1$ and $Z_2$ is 3 to 6, A denotes an unsubstituted $C_1$-$C_6$-alkylene or $C_1$-$C_6$-alkylene substituted with —O—, —$S(O)_p$— or

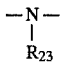

B denotes H, alkyl, aryl, heterocyclyl, acyl, alkylsulfonyl or arylsulfonyl, $L_1$ denotes a single linkage, alkylene, —O—, —S—, —NH— or alkylimino, $L_2$ denotes carbonyl, sulfinyl, sulfonyl, thiocarbonyl, hydroxyphosphoryl, iminomethandiyl or dialkylsilandiyl, $X_1$ denotes aryloxy, alkyloxy, heterocyclyloxy, alkylthio, arylthio, heterocyclylthio or halogen $X_2$ denotes —$SO_2M$, —SH, alkylamino or azacycloalkyl, M denotes H, alkali metal, ammonium, methylenhydrazino, carbonylhydrazo, sulfonylhydrazo, carbonylacetylmethyl or carbonylcarbonyldioxymethyl, Y denotes oxo, thioxo, =N—$R_{24}$ or

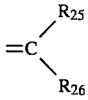

$R_{24}$, $R_{25}$ and $R_{26}$ are the same or different and denote H, alkyl, aryl, heterocyclyl, acyl, alkylsulfonyl, arylsulfonyl, cyano, or $R_{25}$ and $R_{26}$ form together the remaining members of a ring, n denotes 0, 1 or 2, m denotes 0, if $X_1$ is halogen, and 1, if $X_1$ is not halogen, p denotes 0, 1 or 2, $R_{23}$ denotes H, alkyl, aryl, acyl, alkylsulfonyl, alkoxycarbonyl, aryloxycarbonyl, arylsulfonyl, carbamoyl or alkoxycarbonyl.

6. A photographic silver halide material according to claim 1 which is hardened with $CH_2$=CH—$SO_2$—$CH_2$—$SO_2$—CH=$CH_2$ or with $CH_2$=CH—$SO_2$—$CH_2$—O—$CH_2$—$SO_2$—CH=$CH_2$.

7. A photographic silver halide material according to claim 1, which contains compound I in the at least one layer in a quantity of from 50 mg to 5 g/$m^2$.

8. A photographic silver halide material according to claim 1, wherein the compound corresponding to formula I has a molecular weight (weight average) of from 10,000 to 500,000.

9. A photographic silver halide material according to claim 1, wherein the at least one layer contains the compound corresponding to Formula I as a mixture with gelatine, the ratio by weight of compound I to gelatine being adjusted to a value of from 90:10 to 5:95.

10. The photographic silver halide material as claimed in claim 9, wherein the ratio by weight of compound I to gelatine is from 60:40 to 10:90.

11. A photographic silver halide material according to claim 1, characterised in that the instant hardener is used in a quantity of from 50 to 500 mg/m$^2$.

12. A photographic silver halide material according to claim 1, wherein the compound of formula (I) contains —COO or $SO_3H$ groups.

13. A photographic silver halide material according to claim 1, wherein at least one layer containing the compound of formula (I) does not contain gelatine.

14. The photographic silver halide material as claimed in claim 1, wherein $L_1$ and $L_3$ are the same or different and are alkylene; arylene; or aralkylene group having a maximum of 18 carbon atoms.

15. The photographic silver halide material as claimed in claim 1, wherein k stands for 70 to 97% by weight, l stands for 0 to 27% by weight, m stands for 3 to 15% by weight, and j stands for 0 to 27% by weight.

16. The silver halide material as claimed in claim 15, wherein $R_3$ is a —COOH, —$SO_3H$ or —$PO_3H$ group and the compound corresponding to formula I has a molecular weight (weight average) of from 20,000 to 200,000.

17. The photographic silver halide material according to claim 1, wherein $L_1$ and $L_3$ are arylene or aralkylene groups.

18. The photographic silver halide material as claimed in claim 1, wherein the compound corresponding to formula I is selected from the group consisting of

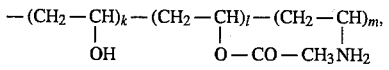
P-1

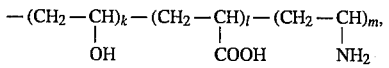
P-2

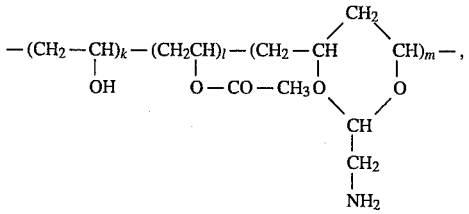
P-3

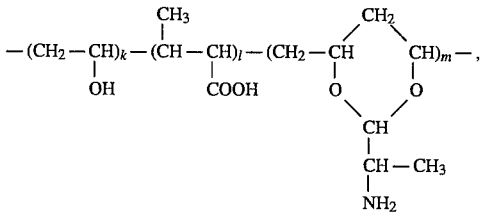
P-4

-continued

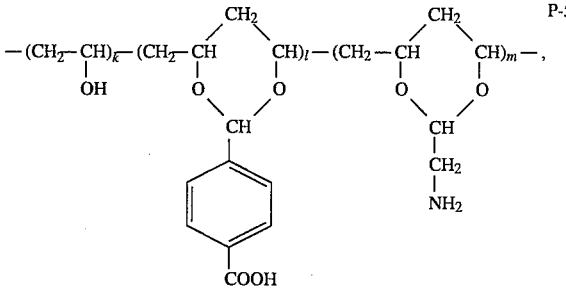
P-5

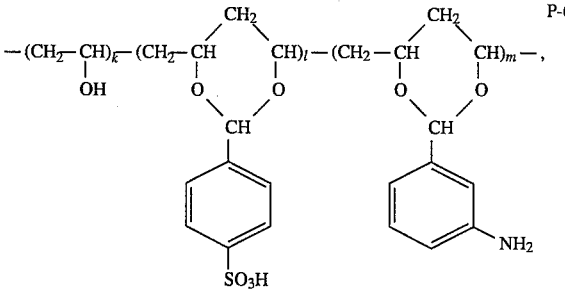
P-6

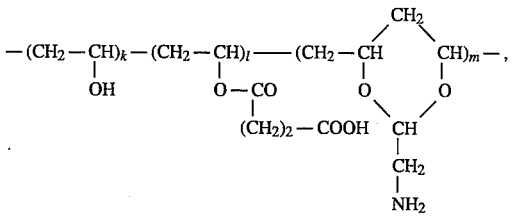
P-7

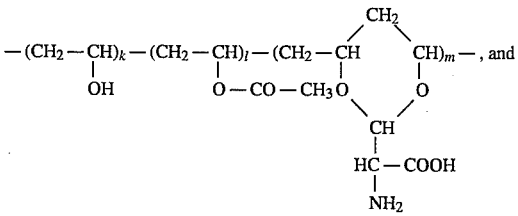
P-8

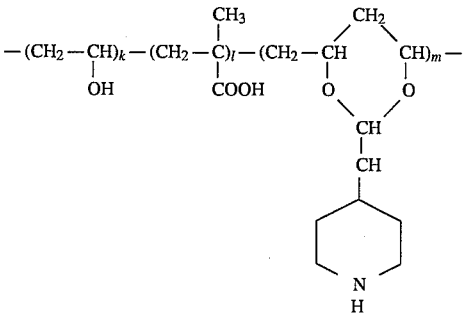
P-9

* * * * *